United States Patent [19]

Modafferi

[11] Patent Number: 4,771,466

[45] Date of Patent: Sep. 13, 1988

[54] MULTIDRIVER LOUDSPEAKER APPARATUS WITH IMPROVED CROSSOVER FILTER CIRCUITS

[75] Inventor: Richard Modafferi, Vestal, N.Y.

[73] Assignee: Modafferi Acoustical Systems, Ltd., Baldwin, N.Y.

[21] Appl. No.: 108,365

[22] Filed: Oct. 13, 1987

Related U.S. Application Data

[63] Continuation of Ser. No. 539,996, Oct. 7, 1983, abandoned, which is a continuation-in-part of Ser. No. 230,442, Feb. 2, 1981, abandoned, which is a continuation-in-part of Ser. No. 78,034, Sep. 24, 1979, abandoned.

[51] Int. Cl.[4] ..... H04R 3/14

[52] U.S. Cl. ..... 381/99; 381/100

[58] Field of Search ..... 381/98, 99, 100; 333/28 R, 28 T, 132, 177, 178; 336/45, 130, 136, 211

[56] References Cited

U.S. PATENT DOCUMENTS

| | | | |
|---|---|---|---|
| 2,612,558 | 9/1952 | Klipsch | 381/99 |
| 3,671,889 | 6/1972 | Favors | 333/177 |
| 3,931,469 | 1/1976 | Elliott et al. | 381/99 |
| 4,039,977 | 8/1977 | Schmidt | 333/28 R |
| 4,237,340 | 12/1980 | Klipsch | 381/99 |
| 4,243,840 | 1/1981 | Kates | 381/99 |
| 4,282,402 | 8/1981 | Liontonia | 381/99 |
| 4,295,006 | 10/1981 | Tanaka et al. | 381/99 |
| 4,315,102 | 2/1982 | Eberbach | 381/99 |

*Primary Examiner*—Jin F. Ng
*Assistant Examiner*—Randall P. Myers
*Attorney, Agent, or Firm*—John F. A. Earley; John F. A. Earley, III; P. Michael Walker

[57] ABSTRACT

A loudspeaker system includes at least two loudspeaker drivers, together with an electrical crossover network having filter circuits with at least two separate mutually exclusive frequency passbands. The filter circuits comprising the crossover network each possess brick-wall amplitude responses, i.e., passbands with very high band-edge amplitude vs. frequency response slops, on the order of 100 dB/octave in the better embodiments. The high passband band-edge slopes, which are realized by the inclusion of transmission zeros in the separate crossover filter transfer functions, takes together with further appropriate crossover filter transfer function synthesis causes the separate loudspeaker drivers comprising the loudspeaker system to function independently of one another in their contribution to total system acoustic output. It is shown that the loudspeaker system permits an accurate approximation to the ideal delay function in acoustic space, while minimizing acoustic wave interference among drivers operating in adjacent frequency band, and also reducing overall system nonlinear distortion.

6 Claims, 16 Drawing Sheets

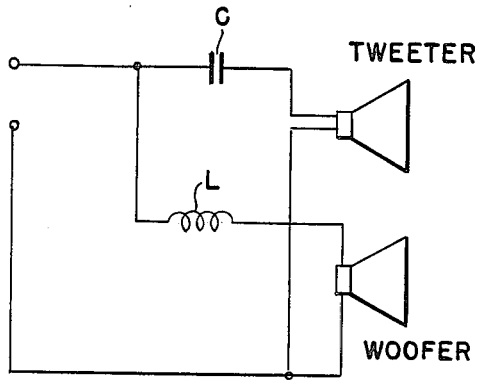
FIG. 1. PRIOR ART
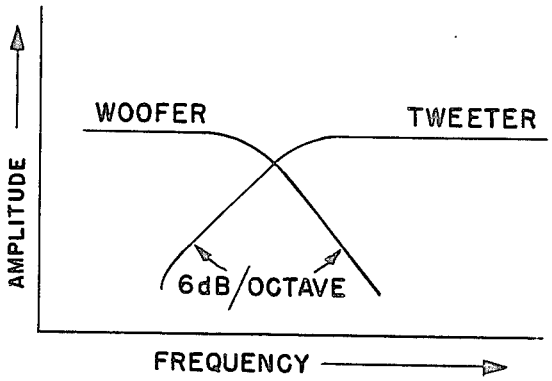
FIG. 2.
FIG. 3.
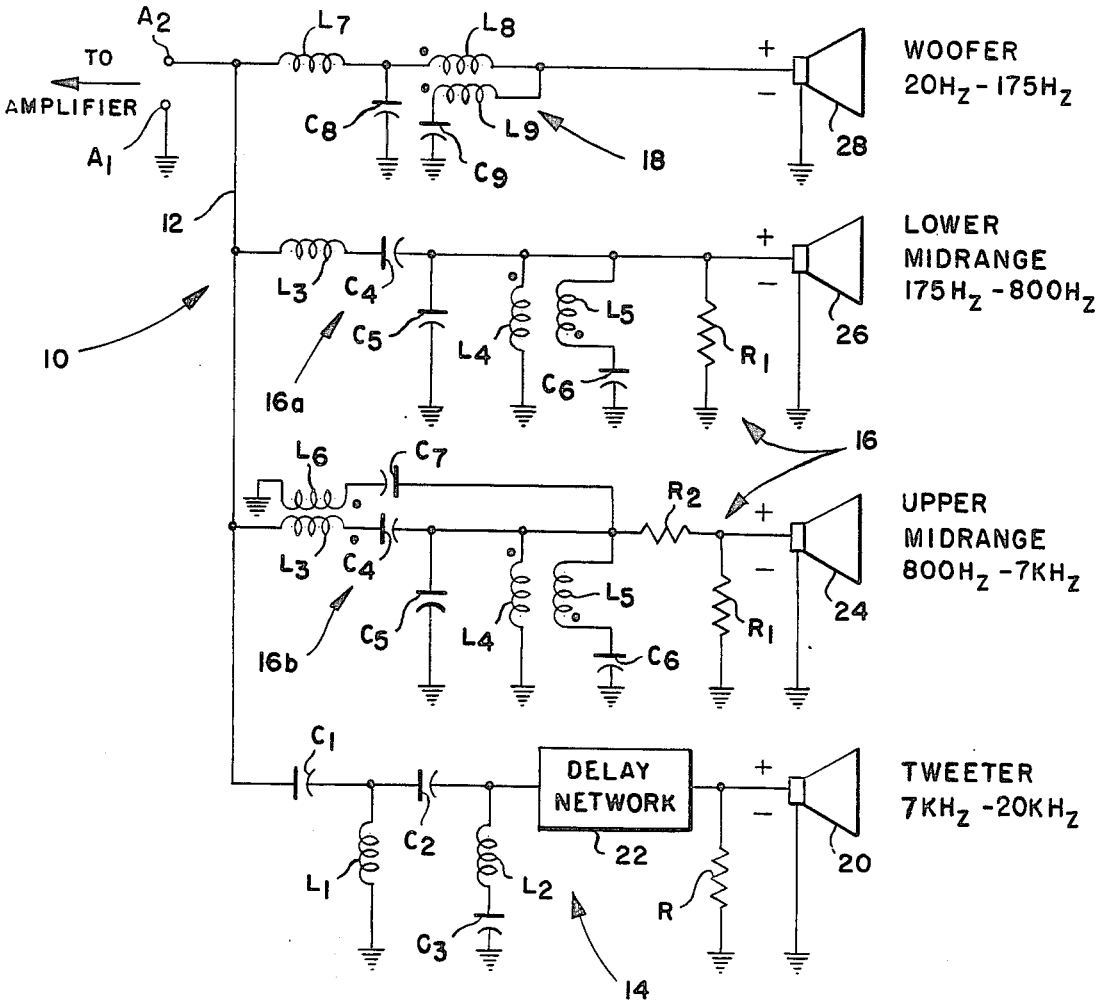

NOTE: COUPLING OF COIL-PAIRS $L_{16}$, $L_{18}$; $L_{21}$, $L_{22}$; & $L_{23}$, $L_{24}$; IS ADJUSTABLE

FIG. 11.
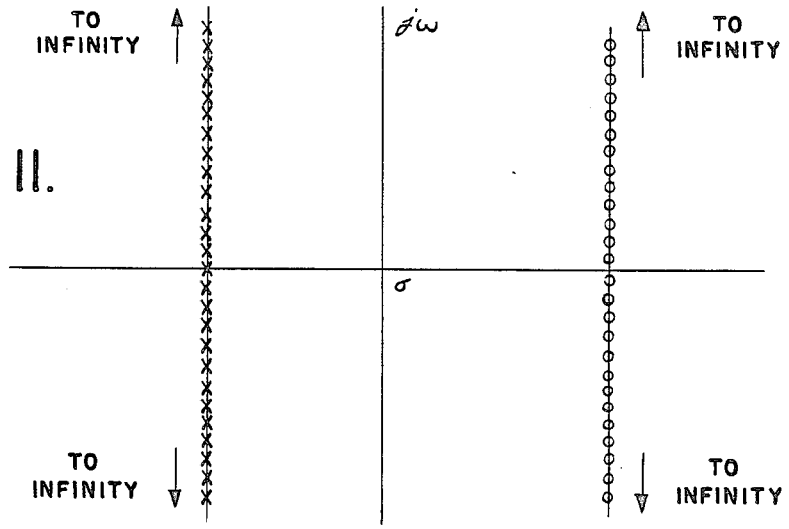
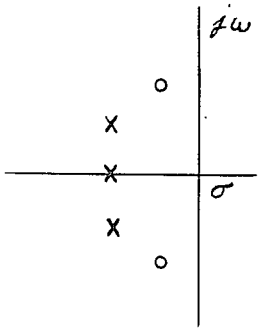
FIG. 12a.
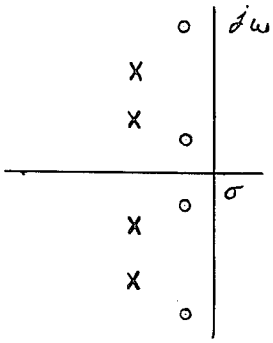
FIG. 12b.
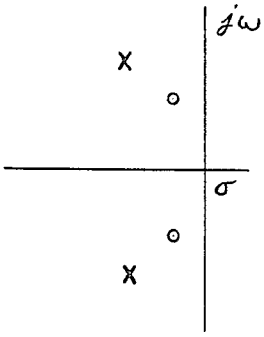
FIG. 12c.
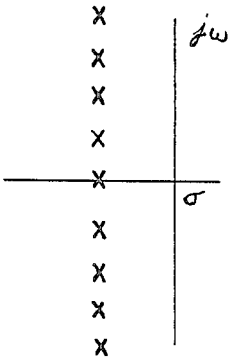
FIG. 12d
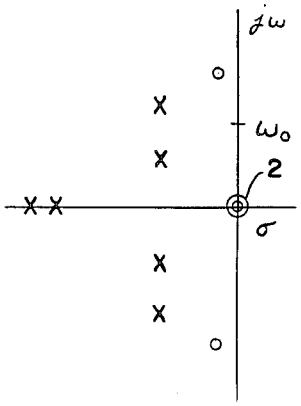
FIG. 14a.
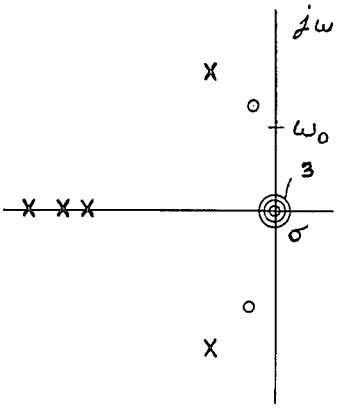
FIG. 14b.
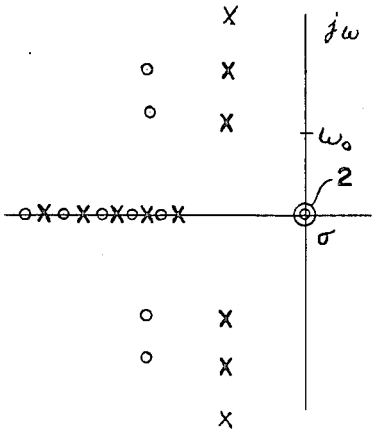
FIG. 14c.

INVENTION EMBODIMENT OF FIG. 10

PRIOR ART LOUDSPEAKER SYSTEM

MULTIDRIVER LOUDSPEAKER APPARATUS WITH IMPROVED CROSSOVER FILTER CIRCUITS

CROSS REFERENCE TO RELATED APPLICATIONS

This application is a continuation of application Ser. No. 539,996 which was a continuation-in-part of application Ser. No. 230,442 that was filed on Feb. 2, 1981, which application was a continuation-in-part of application Ser. No. 78,034 that was filed Sept. 24, 1979, all now abandoned.

BACKGROUND OF THE INVENTION

1. Field of the Invention

The present invention relates to an improvement in means for and to a novel method of so converting electrical signals into sound as to control with high fidelity the acoustic response of a loudspeaker system. More specifically, the invention relates to a loudspeaker system crossover using passive or active circuit topology.

2. Description of the Prior Art and Definition of Terms

In the present state of the art individual loudspeakers or drivers are not capable of accurately reproducing all audio frequencies that are detectable by the human ear. High fidelity loudspeaker systems have been realized in the prior art, however, by dividing the audio frequency spectrum into two or more frequency bands, and applying each of these portions of the audio spectrum to a separate driver or group of drivers.

For this purpose special electrical filters, called crossover networks, have been provided that allow the different drivers or groups of drivers, each adapted for best response to a particular range or band of frequencies, to be combined in a single system capable of wide frequency coverage. The crossover circuit directs the electrical signals of widely varying frequency to the appropriate driver or group of drivers in a multidriver loudspeaker system.

Crossover network filter topologies, in general, belong to three classifications according to the frequencies passed and rejected, as follows:

(1) Low-pass for woofers, (2) Band-pass for midranges, and (3) High-pass for tweeters, where woofers are low frequency drivers and respond to the low frequencies, midrange drivers respond to the midrange frequencies, and tweeters are high frequency drivers and respond to the high frequencies. Where more than one filter is used, the frequency common to adjacent ranges or passbands is called the crossover frequency.

For "perfect" fidelity it can be demonstrated mathematically that a loudspeaker system crossover using passive or active circuit topology must realize perfectly the ideal all pass transfer function of Equation (1):

$$f(s)=Ke^{-sT} \quad (1)$$

Where s is the complex frequency variable $s=\sigma+jw$ K and T are real, positive constants; and e=2.718 or, $$G(s)=Ke^{-sT} \quad (1)$$

with s, K, T, and e defined as above, where whichever form the transfer function implied by Equation (1) is relevant to a particular case will become clear when the separate meanings of f(s) and G(s) are defined hereinafter. It is not possible, however, using current technology, to perfectly realize the ideal all pass transfer function in three-dimensional acoustic space with any known loudspeaker system. Accordingly, all real loudspeaker system configurations or designs are based upon an approximation to one or both forms of the ideal transfer function of Equation (1) in three-dimensional space.

The simplest and commonest prior art approximation to the ideal loudspeaker system is based upon a "two-way" design using an assumed ideal woofer and tweeter combined with a simple 6 dB/octave minimum-phase, low-pass-high-pass, cross-over network, as illustrated in FIG. 1. Mathematically, this approach takes the ideal transfer function of Equation (1) and attempts to reduce it to a function that is independent of frequency, ideally a constant. This is accomplished by expanding the ideal transfer function of Equation (1) in a power series, as follows: when K=1, then $$f_0(s) = e^{-sT} = \frac{1}{e^{sT}} = \frac{1}{1 + sT + (sT)^2/2! + (sT)^3/3! + \ldots} \quad (2)$$

Taking only the first term of this series of Equation (2) gives:

$$f_1(s) = \frac{1}{1 + sT} \quad (3)$$

Those skilled in the art will recognize Equation (3) as the simple one-pole low pass transfer function.

If the term s in Equation (3) is replaced by $(1/sT)^2$, the complementary high-pass transfer function with cross-over frequency 1/T is obtained:

$$f_2(s) = \frac{1}{1 + sT} \mid^{WITH\ s} = \frac{1}{sT^2} \rightarrow \frac{1}{1 + \frac{1}{sT}} = \frac{sT}{1 + sT} \quad (4)$$

Plots of the complementary amplitude response $f_1(s)$ and $f_2(s)$ of Equations (3) and (4) are given in FIG. 2.

Equation (5) below shows that the sum of the simple low-pass function of Equation (3) and its complementary high-pass function of Equation (4) is unity, that is, a constant that is independent of frequency:

$$f_3(s) = f_1(s) + f_2(s) = \frac{1}{1 + sT} + \frac{sT}{1 + sT} = \frac{1 + sT}{1 + sT} = 1 \quad (4)$$

If an ideal woofer were connected to a cross-over network having the transfer response of Equation (3) and an ideal tweeter were connected to a crossover network having the transfer response of Equation (4), and the woofer and tweeter were combined in a single system, the result would be a "perfect" loudspeaker system. Its amplitude response would be perfectly flat for all frequencies and there would be no phase shift at any frequency.

Serious problems arise, however, when it is attempted to construct a practical loudspeaker system following the foregoing design procedure. These problems arise from three distinct causes:

(1.1) The woofer and tweeter do not have ideal amplitude and/or phase characteristics.

(1.2) The loudspeaker drivers function in three-dimensional acoustic space in which the simple energy relation of Equation (5) is not valid at all points.

(1.3) The gradual crossover slope (6 dB/octave) allows too much bass energy to enter the tweeter, and too much treble energy to enter the woofer, causing distortion.

Even with the reservations just mentioned, the simple two-way loudspeaker system of FIG. 2 approaches the ideal to a degree sufficient to achieve moderately satisfactory performance.

It should be noted that the transfer function f(s) as discussed here so far is that of the electrical cross-over circuits alone, i.e., f(s) is defined as:

$$f(s) = \frac{eo}{e} = \frac{P(s)}{Q(s)} \tag{1a}$$

which, in words, represents the ratio of electrical energy at the output of a general crossover filter circuit, or combination of filter circuits including a complete crossover system, to the electrical energy at the input, expressed as a function of complex frequency.

The assumption has been implicitly made so far in this discussion that the transfer function of the loudspeaker drivers (defined immediately hereinafter) is either unity, or an "ideal delay" and thus may be ignored. This is, at best, only approximately true. The transfer function of a loudspeaker driver is an electroacoustical quantity and may be defined as the ratio of the sound pressure at a point in the listening environment to the electrical energy input to the driver terminals; this expresion being a ratio of terms in complex frequency:

$$H(s) = \frac{p}{e} = \frac{P_1(s)}{Q_1(s)} \tag{1b}$$

Thus one can consider the overall transfer function of a complete speaker system taken as a whole—crossover plus loudspeaker drivers—which would be the product of the two abovementioned transfer functions and would be defined as:

$$G(s) = f(s)H(s) = \frac{P_1}{e} = \frac{P_2(s)}{Q_2(s)} \tag{1c}$$

The transfer function G(s) represents the ratio of acoustic sound pressure at a particular point in the listening environment to the electrical energy applied to the input terminals of the speaker system, both as a function of complex frequency. The terms $P_2(s)$ and $Q_2(s)$ will contain the poles and zeros (p-z) of the loudspeaker drivers as well as the p-z of the crossover elements.

Well-designed loudspeaker drivers possess a band of frequencies in which the amplitude response is flat to desired accuracy, and phase response is linear to desired accuracy—such loudspeaker drivers may be referred to as "ideal" and will possess an electroacoustical transfer function H(s) which can be considered to be unity or a constant. Loudspeaker drivers will be considered to possess ideal delay—i.e., to approximate Equation (1) to a high degree of accuracy within their respective frequency bands of best performance—unless specifically stated otherwise. Hereinafter, transfer functions designated as f(s) will always relate to the crossover only, while transfer functions designated G(s) will always relate to the crossover filter circuits plus the loudspeaker drivers, with definitions as set forth hereinbefore.

Those skilled in the art will understand that the units of the right-hand terms contained in Equation (1a) are voltages and currents which relate to the electrical circuit of the crossover network under consideration. The units of the right-hand terms of Equations (1b) and (1c) are voltages, currents, forces, velocities, pressures, and volume velocities, which relate to the electrical circuit (crossover), the mechanical circuit (the loudspeaker driver), and the acoustical circuit (the air surrounding the loudspeaker driver). For a numerical solution to specific forms of Equations (1b) and (1c), or any other equation contained herein with mixed electrical, mechanical, and/or acoustical circuits, such as Equation (8) expressed hereinafter, the method of "dynamic analogies" must be employed. This method is amply treated in the text *Acoustics,* Chapters 3 and 5, by Leo Beranek, McGraw-Hill, 1947. Hereinafter, this method of dynamic analogies will be implicitly assumed to have been applied whenever an "acoustic" sum is discussed with respect to an equation containing "mixed", i.e., electroacoustical units.

Returning to the earlier discussion, it is observed that closer approximations to the ideal transfer function of Equation (1) have traditionally been realized by taking more terms of the infinite series of Equation (2), again attempting to reduce the result to a function independent of frequency, and then using such function as a basis for design considerations. Some of these methods have been treated in the prior art and in particular, in several issues of the Audio Engineering Society Journal, specifically in the following articles: "Constant Voltage Crossover Network Design", Richard Small, January, 1971; "Active and Passive Filters in Loudspeaker Crossover Networks", Ashley and Kaminsky, June 1971; and "A Novel Approach to Linear Phase Loudspeakers Using Passive Crossover Networks", E. Backgaard, May 1977.

When such prior art loudspeaker topologies are considered with reference to the poles and zeros of the resultant system input-output transfer function, it is found that all poles and zeros, that is all p-z, tend to disappear. In general most prior art loudspeaker designs or configurations have utilized acoustic summations which caused the disappearance of as many p-z as possible in the summation while tending toward some good approximation of the transfer function of Equation (1). The present invention takes an opposite approach, that is, retaining all, or as many as possible, of the p-z of the individual elements in the final summation. Also crucial to the method of this invention is the inclusion of transmission zeros in the design of the crossover filter circuits. These transmission zeros, taken together with retention in the total loudspeaker system of the dominant poles inherent in the separate crossover filter circuits allows the approximation of the transfer function of Equation (1) to a high degree of accuracy, while also overcoming the problems, mentioned above (1.1, 1.2 and 1.3), of the prior art loudspeaker designs.

SUMMARY OF THE INVENTION

A descriptive name will be given to the present invention; operative embodiments of the same will sometimes be referred to hereinafter as "infinite-slope" speaker systems.

A general object of the invention is to provide an improvement in a loudspeaker system crossover using passive or active circuit topology which accurately approximates the ideal transfer function of Equation (1).

Another object of the invention is to provide an improved method for converting varying electrical signals into sound involving the utilization of crossover circuits that maintain all or as many as possible of the dominant poles of the individual crossover filter circuit transfer functions defined by Equation (1a) hereinbefore.

A further object of the invention is to provide an improved method of converting varying electrical signals into sound in which the poles of the transfer function of any filter circuit of the loudspeaker system may not be repeated in the transfer function of any other filter circuit of the loudspeaker system, thereby satisfying a necessary criterion assuring that the individual crossover filter circuits will possess mutually exclusive frequency passbands.

A further object of the invention is to provide such an improved method for converting varying electrical signals into sound wherein the individual crossover filter-loudspeaker driver combinations comprising the invention are caused to function independently of each other in forming the total acoustic sum, or total acoustic output, by the use of two or more distinct "brick-wall" amplitude functions having separate mutually exclusive frequency passbands, which passbands in addition possess very high band edge amplitude vs. frequency response slopes. Brick-wall amplitude functions are defined in the text *Circuit Theory and Design,* Chapter 5, by John L. Stewart, John Wiley and Sons, Inc., New York, 1956.

A more specific object of the invention is to provide an improved crossover network for a loudspeaker system wherein mutually-coupled coils are used in order to enhance the steepness of the passband band-edge amplitude vs. frequency response slopes.

Still another object of the invention is to provide an improved loudspeaker crossover network embodying all-pass delay equalization of one or more filter circuits in order to achieve a more accurate approximation to the ideal transfer function of Equation (1).

A further object of the invention is to provide an improved loudspeaker system in which the crossover circuit parameters and driver placement are so adjusted that the band-width of audible frequency bands of mutual acoustic interference are reduced to less than $\frac{1}{3}$ octave.

Another object of the invention is to provide an improved loudspeaker system in which the electrical parameters of the crossover network include transmission zeros placed at frequencies just outside the passbands of the individual crossover filter circuits (low-pass, band-pass, and high-pass) in order to achieve very high passband band edge amplitude vs. frequency response slopes.

In accomplishing the foregoing and other objectives of the present invention active or passive topologies may be employed. Since passive topologies are most commonly used in loudspeaker system crossovers, the discussion that follows is concerned mostly with passive circuitry. Active circuit embodiments of the invention, however, will also be discussed.

The present invention achieves a new approximation to the ideal transfer function in a novel manner. Particular attention is paid to the problems mentioned above (1.1, 1.2, and 1.3). The invention will be shown to:

(1.4) Greatly minimize the undesirable effects of non-ideal driver amplitude and phase response on total system performance.

(1.5) Minimize the acoustic wave interference between drivers at the crossover frequencies.

(1.6) Reduce total system harmonic and intermodulation distortion.

The method of the invention takes into consideration two ideas:

(1.7) The total system performance must relate to an "acoustic" sum of driver energies in three-dimensional space.

(1.8) The ideal transfer function of Equation (1) is approached using embodiments of the present invention which operate by acoustically summing two or more approximations to ideal "brick-wall" amplitude functions, all having separate mutually-exclusive frequency passbands. If these amplitude functions are carefully chosen, the acoustic sum will not only approach a flat amplitude vs. frequency characteristic, but will also approach a linear-phase vs. frequency characteristic, with, at most, an ambiguity of phase of $\pm 2n\pi$ radians (where $n=0, 1, 2, 3, \ldots$) at the crossover frequencies. Observe that if $n=0$, the drivers are absolutely as well as relatively in phase, and no phase ambiguity exists.

In accordance with the invention, a quasi-infinite crossover band-edge slope is achieved by employing crossover circuit topologies which have zeros of transmission placed at frequencies outside their respective band edges. Mutually-coupled coils may be used in order to improve out-of-band attenuation, in passive embodiments. Both minimum-phase and non-minimum-phase topologies are allowed. In-band amplitude and phase characteristics of the loudspeaker drivers may be considered as part of the overall system transfer function. Crossover filter passband band-edge amplitude vs. frequency response slopes in embodiments of the present invention approach 100 dB/octave with minimum out-of-band attenuation being greater than 40 dB. This is in sharp contrast to the monotonic 6, 12, or 18 dB/octave crossover slopes commonly used in the prior art loudspeaker systems.

There is no fixed way to embody the invention. Any combination of active or passive crossover topologies satisfying the requirements of the idea statement of 1.8 above and fitting into the described three classifications of general crossover circuit topologies, while approximating the transfer function of Equation (1), will work. Crossover topologies in an operative invention embodiment will possess filter circuits having (1) separate and mutually exclusive frequency passbands and (2) at least one transmission zero in each filter circuit. Those skilled in the art will recognize the aforementioned to be characteristic to one class of brick-wall amplitude functions.

BRIEF DESCRIPTION OF THE DRAWINGS

A better understanding of the invention may be had when the following detailed description is read in connection with the accompanying drawings in which:

FIG. 1, referred to previously herein, illustrates a typical prior art loudspeaker system;

FIG. 2, also referred to previously herein, illustrates plots of the complementary low-pass and high pass amplitude responses of the loudspeaker system of FIG. 1;

FIG. 3 is a circuit diagram illustrating a passive embodiment of the invention;

FIG. 11 is a pole-zero pattern illustrating the p-z required for a perfect realization of the invention;

FIGS. 12*a*, 12*b* and 12*c* are pole-zero patterns illustrating the dominant p-z for the low-pass, band-pass, and high-pass filter circuits, respectively, of a general embodiment of the invention;

FIG. 12*d* is a pole-zero pattern showing a summation of the dominant p-z of the pole-zero plots of FIGS. 12*a*, 12*b* and 12*c;*

FIGS. 14*a*, 14*b* and 14*c* are pole-zero patterns justifying the network topologies according to the invention;

FIG. 16(*b*) illustrates the overall on-axis frequency response of the entire system of FIG. 10;

FIG. 16(*c*) illustrates the delay response of FIG. 10;

FIG. 17(*b*) illustrates the overall on-axis response of the entire system of FIG. 15*b;*

FIG. 19(*b*) illustrates pictorially the microphone positions used in the measurements of FIG. 19(*a*);

FIG. 19(*c*) illustrates the amplitude vs. frequency response for a prior art loudspeaker system for response measurements taken using different positions of the test microphone;

FIG. 19(*d*) illustrates pictorially the microphone positions used in the measurements of FIG. 19(*c*);

DESCRIPTION OF THE PREFERRED EMBODIMENTS

Figure 4A:
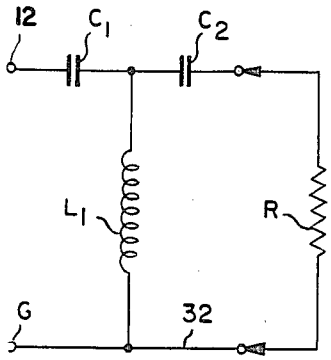
FIG. 4*a* is a high-pass network illustrating the tweeter topology,employed in the circuit of FIG. 3.

For a better understanding of the preferred embodiments of the invention, reference is first made to the loudspeaker circuit diagram of FIG. 3. In FIG. 3 electrical signals representing sound to be reproduced appear at the output terminals of an exterior component (not shown) such as a suitable amplifier. One output terminal, $A_1$, of the amplifier is connected to ground potential and the other output terminal, $A_2$, is connected to a conductor 12 of a loudspeaker crossover filter network 10. Conductor 12 is common to a high-pass, a band-pass, and low-pass filter or circuit means 14, 16, and 18 in the network 10, each of which limits the frequency range of signals passing therethrough.

As shown in FIG. 3, a tweeter 20 is connected to the output of the high-pass filter circuit 14 and responds to electrical signals in the range of 7 KHz to 20 KHz. The filter circuit 14 and tweeter 20 form a first crossover filter-loudspeaker driver combination. A delay network 22 is provided between the tweeter 20 and the output of the high-pass filter circuit 14. The purpose of the delay network 22 is explained hereinafter.

The band-pass filter circuit 16 includes a lower midrange section 16*a* and an upper midrange section 16*b*. An upper midrange driver 24 is connected to the output of the upper midrange section 16*b*, forming therewith a second crossover filter-loudspeaker driver combination. Similarly, a lower midrange driver 26 is connected to the output of the lower midrange section 16*a*, forming therewith a third filter loudspeaker combination. Lower midrange driver 26 responds to electrical signals in the range of 175 Hz to 800 Hz. Upper midrange driver 24 responds to signals in the range of 800 Hz to 7 KHz.

A woofer 28 is connected to the output of the low-pass filter circuit 18 and responds to electrical signals in the range of frequencies from 20 Hz to 175 Hz. The filter circuit 18 and woofer 28 form a fourth crossover filter-loudspeaker driver combination.

In accordance with the invention, the four separate filter circuit-loudspeaker driver combinations operate independently of each other in forming the total acoustic output of the system.

The tweeter topology selected for the FIG. 3 embodiment is based upon the high-pass network illustrated in FIG. 4*a* and, as shown, includes a series connection from a first input terminal 12, to capacitors $C_1$ and $C_2$ and a terminating resistor R to a conductor 32 that leads to a second input terminal G with an inductor $L_1$ connected between the junction of capacitors $C_1$ and $C_2$ and the conductor 32. It is noted that most passive crossover networks are synthesized on the assumption that the network is terminated by a pure and constant resistance.

Figure 4B:
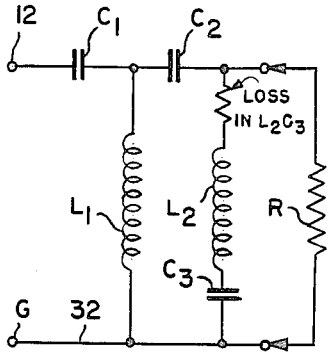
FIG. 4*b* is a network of FIG. 4*a* with a zero of transmission added.
Figure 4C:
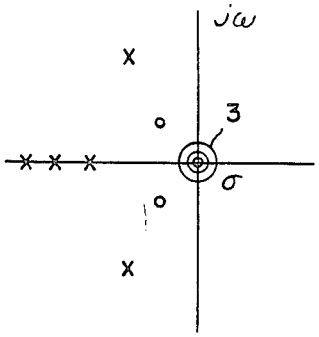
FIG. 4*c* is a pole-zero pattern or plot showing the p-z yielded by the network of FIG. 4*b;*

A zero of transmission is added to the high-pass network of FIG. 4*a*, as is illustrated in FIG. 4*b*, by connecting an inductor $L_2$ and a capacitor $C_3$ in series between the junction of capacitor $C_2$ and resistor R to the conductor 32. Mutual coupling between the inductors $L_1$ and $L_2$ is not used here as it would cause the out-of-band input impedance to become excessively low. The network of FIG. 4*b* yields the poles and zeros, that is, p-z shown in the pole-zero pattern of FIG. 4*c*.

Figure 5A:
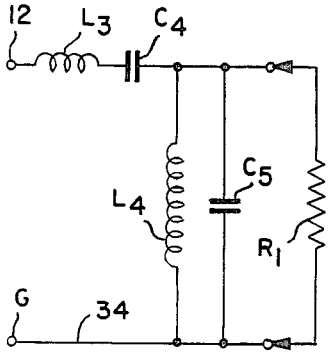
FIG. 5*a* is a half-section band-pass network employed in the mid-range topology of the circuit of FIG. 3.

Midrange topology selected for the midrange drivers 24 and 26 is based upon the simple half-section band-pass network illustrated in FIG. 5*a*. As shown, FIG. 5*a* includes an inductor $L_3$ and a capacitor $C_4$ connected in series with a resistor $R_1$ between a first input terminal 12 and a conductor 34 leading to a second input terminal G. There is also provided a parallel connection of an inductor $L_4$ and capacitor $C_5$ between the junction of capacitor $C_4$ and resistor $R_1$ and the conductor 34.

Figure 5B:
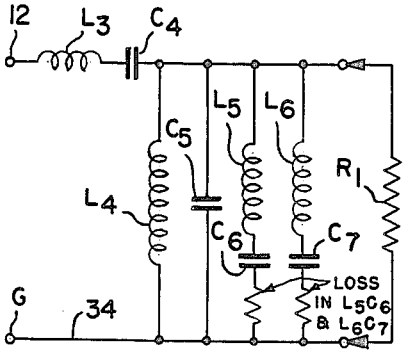
FIG. 5*b* is the half section network of FIG. 5*a* with a first zero of transmission placed below the low frequency crossover point and, a second zero of transmission placed above the high-frequency point.

Zeros of transmission are added to the network of FIG. 5*a* as is shown in FIG. 5*b*. A single zero of transmission is provided for the lower midrange circuit 16*a* by the addition in parallel to the inductor $L_4$ and capacitor $C_5$ of an inductor $L_5$ and a capacitor $C_6$ which are connected in series Mutual inductance is provided, as shown in FIG. 3, between inductors $L_5$ and $L_4$. This zero of transmission is placed above the lower midrange crossover frequency.

For the upper midrange circuit 16*b*, there is further provided in parallel to the inductor $L_4$ and capacitor $C_5$ an inductor $L_6$ and a capacitor $C_7$ which are connected in series. Mutual coupling is provided between inductors $L_6$ and $L_3$, as shown in FIG. 3, in order to improve the attenuation of the higher frequencies above the upper midrange.

Figure 5C:
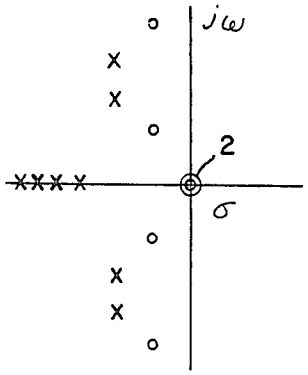
FIG. 5*c* is a pole-zero pattern showing the p-z yielded by the network of FIG. 5*b;*

More than one zero of transmission may be used for the midrange or band-pass frequencies. In the FIG. 3 upper midrange crossover, one is placed below the low frequency point and the other above the high frequency point. These zeros of transmission are generally placed one octave below the lower midrange crossover frequency, and one half octave above the higher midrange crossover frequency. General p-z for the network of FIG. 5*b* are given in the pole-zero pattern of FIG. 5*c*.

Figure 6A:
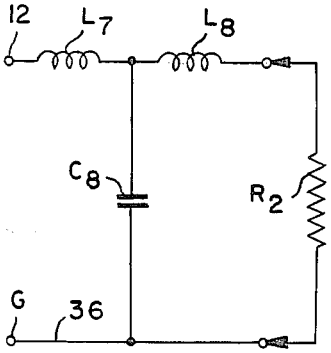
FIG. 6*a* is a basic T-section network illustrating the woofer or low-pass topology employed in the circuit of FIG. 3.

The low-pass topology selected for the FIG. 3 embodiment is the basic T-section network as shown in FIG. 6*a* and includes series-connected inductors $L_7$ and $L_8$ and a terminating resistor $R_2$ between first input terminal 12 and a conductor 36 leading to a second input terminal G. The network also includes a capacitor $C_8$, one terminal of which is connected to the junction of inductors $L_7$ and $L_8$ and the other terminal to the conductor 36.

Figure 6B:
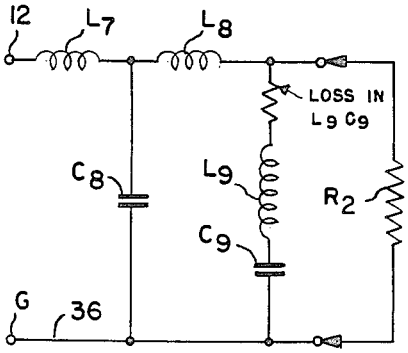
FIG. 6*b* is the network of FIG. 6*a* with a zero of transmission added.
Figure 6C:
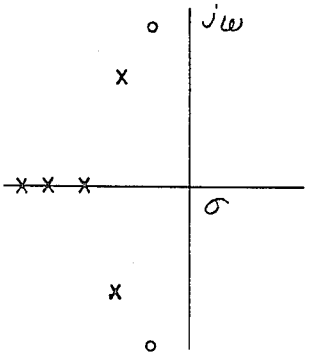
FIG. 6*c* is a pole-zero pattern showing the p-z yielded by the network of FIG. 6*b;*

A zero of transmission is added to the network of FIG. 6*a* as is illustrated in FIG. 6*b* by the connection of an inductor $L_9$ and a capacitor $C_9$ in series between the junction of inductor $L_8$ and resistor $R_2$ and the conductor 36. The zero of transmission thus added to the network as shown in FIG. 6*b* yields the p-z shown in the pole-zero pattern of FIG. 6*c*. The zero of transmission will usually use mutual coupling of inductances $L_8$ and $L_9$, as is illustrated in FIG. 3, at 18. This zero of transmission is placed one to two octaves above the woofer crossover frequency.

By way of illustration and not limitation it is noted that in the embodiment of the invention of FIG. 3 the electrical parameters of the individual components of the high pass, upper midrange, lower midrange and low pass sections 14, 16*b*, 16*a*, and 18, respectively, are as follows:

| High pass section 14 | | Low pass section 18 | |
|---|---|---|---|
| $L_1$ | 125 microhenries | $L_7$ | 6 millihenries |
| $L_2$ | 320 microhenries | $L_8$ | 5.1 millihenries |
| $C_1$ | 2 microfarads | $L_9$ | 3.3 millihenries |
| $C_2$ | 2 microfarads | $C_8$ | 220 microfarads |
| R | 27 ohms | $C_9$ | 47 microfarads |
| **Upper midrange section 16b** | | **Lower midrange section 16a** | |
| $L_3$ | 275 microhenries | $L_3$ | 1.75 millihenries |
| $L_4$ | 1.07 millihenries | $L_4$ | 3.82 millihenries |
| $L_5$ | 1.92 millihenries | $L_5$ | 1.07 millihenries |
| $L_6$ | 190 microhenries | $C_4$ | 100 microfarads |
| $C_4$ | 12 microfarads | $C_5$ | 22 microfarads |
| $C_5$ | 6.8 microfarads | $C_6$ | 22 microfarads |
| $C_6$ | 56 microfarads | $R_1$ | 15 ohms |
| $C_7$ | 2 microfarads | | |
| $R_1$ | 15 ohms | | |
| $R_2$ | 3 ohms | | |

Figure 7:
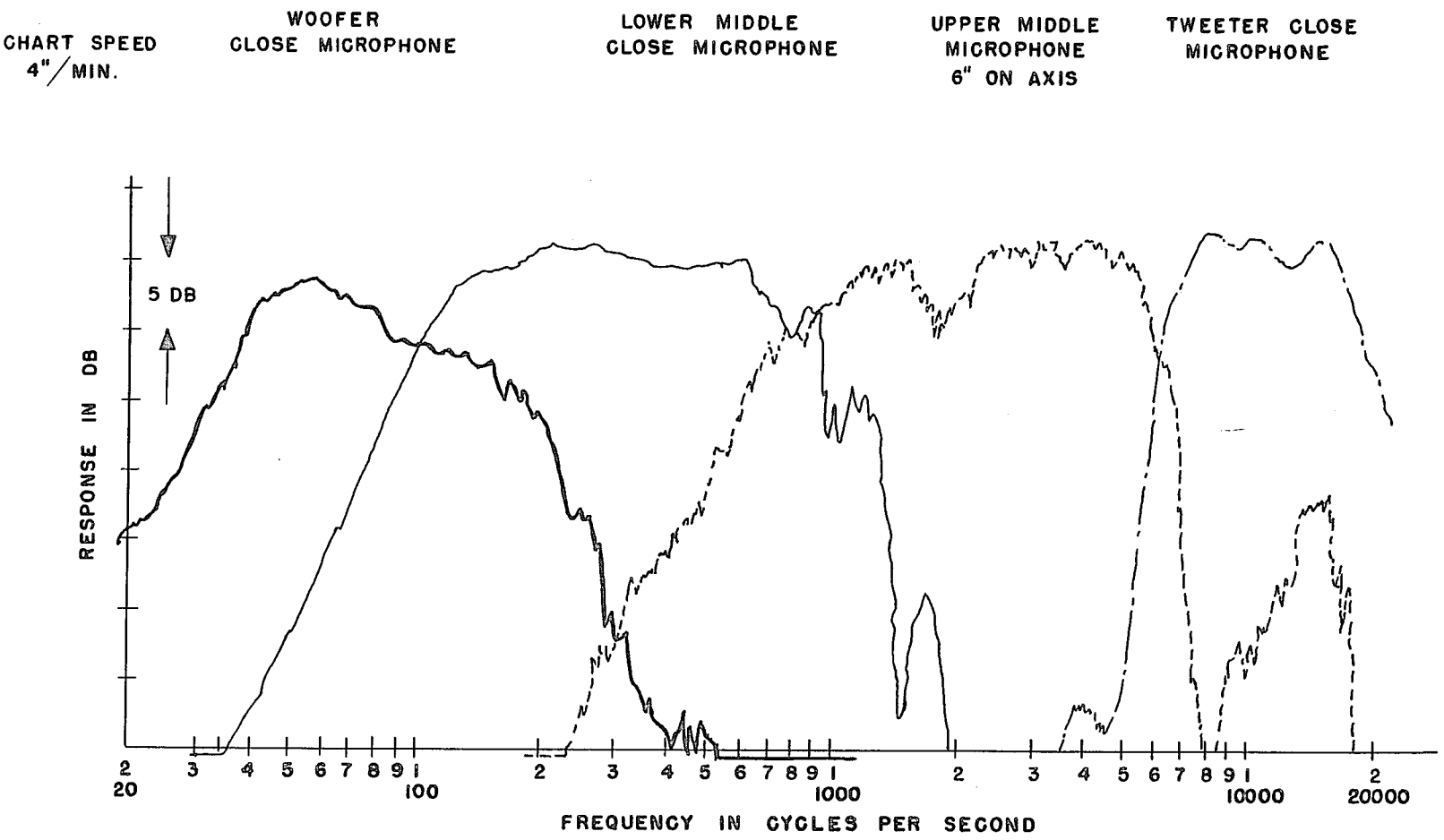
FIG. 7 illustrates the frequency response of the individual drivers of the circuit of FIG. 3.

The frequency response of the inidividual drivers of the FIG. 3 system is illustrated in the chart of FIG. 7. This chart represents close microphone tests on individual drivers, with all other drivers open or shorted. As those skilled in the art understand, the term "close microphone" refers to a technique for measuring the sound output of a loudspeaker diaphragm by placing the microphone very close to the diaphragm, typically $\frac{1}{4}$" to $\frac{1}{2}$".

It is noted that the small loop under the tweeter response curve in FIG. 7 is a spurious response form the upper midrange driver 24. This spurious response is a fault of the driver 24 and can be eliminated by placing a 20 $\mu$H inductor in series with capacitor $C_5$ of FIG. 3. The spurious response, however is of little or no consequence, being about 15 dB down and inaudible.

Figure 8:
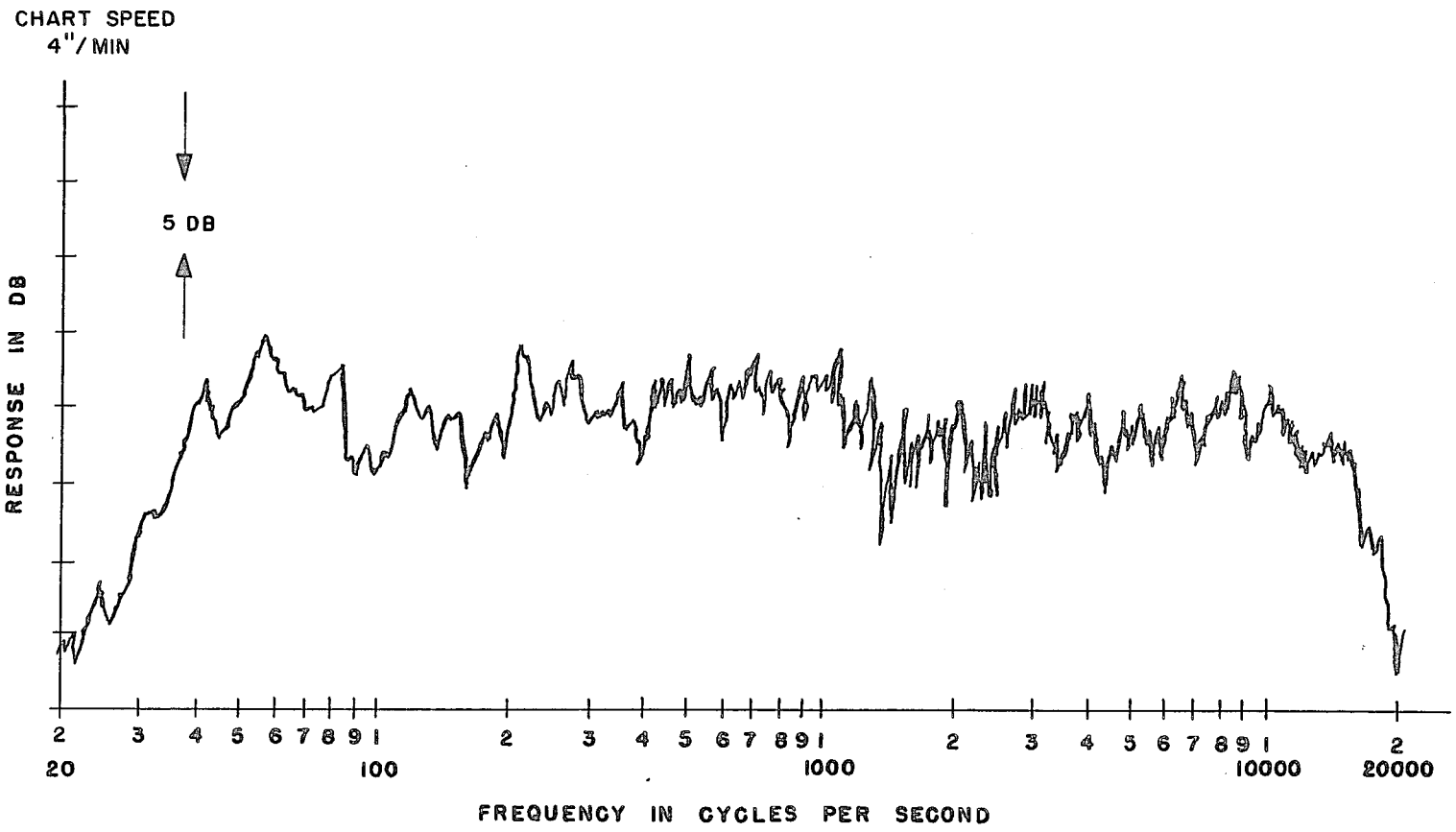
FIG. 8 illustrates the composite frequency response of the whole system of FIG. 3, that is, the total acoustic sum of all drivers on axis.

The chart of FIG. 7 and that also of FIG. 8, now to be described, were run 4 inches per minute.

The composite frequency response of the whole system, that is, including the total acoustic sum of all drivers on axis, is illustrated in FIG. 8. It is evident that the amplitude response given in FIG. 8 is a good approximation to the amplitude criterion of the transfer function of Equation (1). Consideration must still be given, however, as to how well the embodiment of FIG. 3 approaches the ideal phase characteristic implied in Equation (1).

Figure 9:
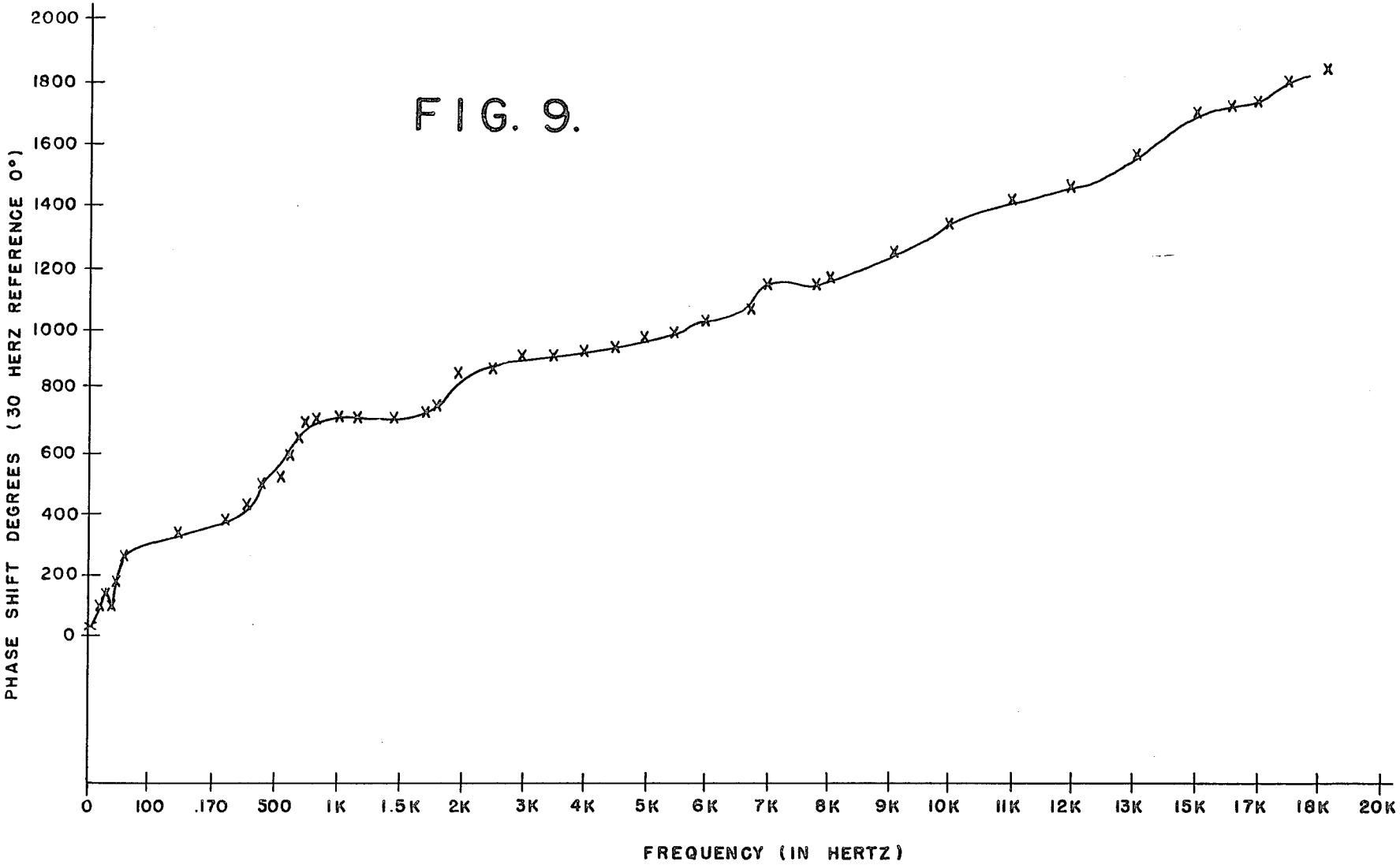
FIG. 9 is a plot of the phase response of the system of FIG. 3.

FIG. 9 is a plot of the phase response of the embodiment of FIG. 3. Ideally, in order to satisfy the ideal phase requirements implicit in Equation (1), the phase response shall be a straight line throughout the entire frequency range. A compromise may be made, however, by allowing the phase response to exhibit changes in slope and/or discontinuities at the crossover frequencies. In FIG. 9, the phase response exhibits a constant slope above 1000 Hz while breaking into a steeper slope below 1000 Hz and then becoming irregular at low bass frequencies.

The phase curve of FIG. 9 implies the existence of a relative time difference of about 800 microseconds between mid-range frequencies (175–1000 Hz) and high frequencies (1000–20,000 Hz). Acoustical researchers are in general disagreement as to whether small acoustical time delay errors (of the order of 1 ms.) are audible.

Whether such errors are audible or not is moot, as the present invention permits such errors to be essentially eliminated.

The invention embodiment of FIG. 3 uses an all pass delay network for correction of phase response. Thus, the all pass delay network 22 in series with the tweeter 20 matches the delay of the tweeter 20 to that of the upper midrange 24. A detailed discussion of the theory and design of delay networks will not be undertaken here. For those skilled in the art, the relevant theory is disclosed in the text *Network Analysis and Synthesis*, by F. F. Kuo, John Wiley, 1962, pages 315 to 321.

It is noted that at low frequencies (175 Hz and lower) the ear becomes less sensitive to phase and directionality. Thus irregularities in phase inherent in low bass loudspeaker response are relatively insignificant. The present invention finds particular application above the low bass frequency region, that is, frequencies above 175 Hz.

Figure 10:
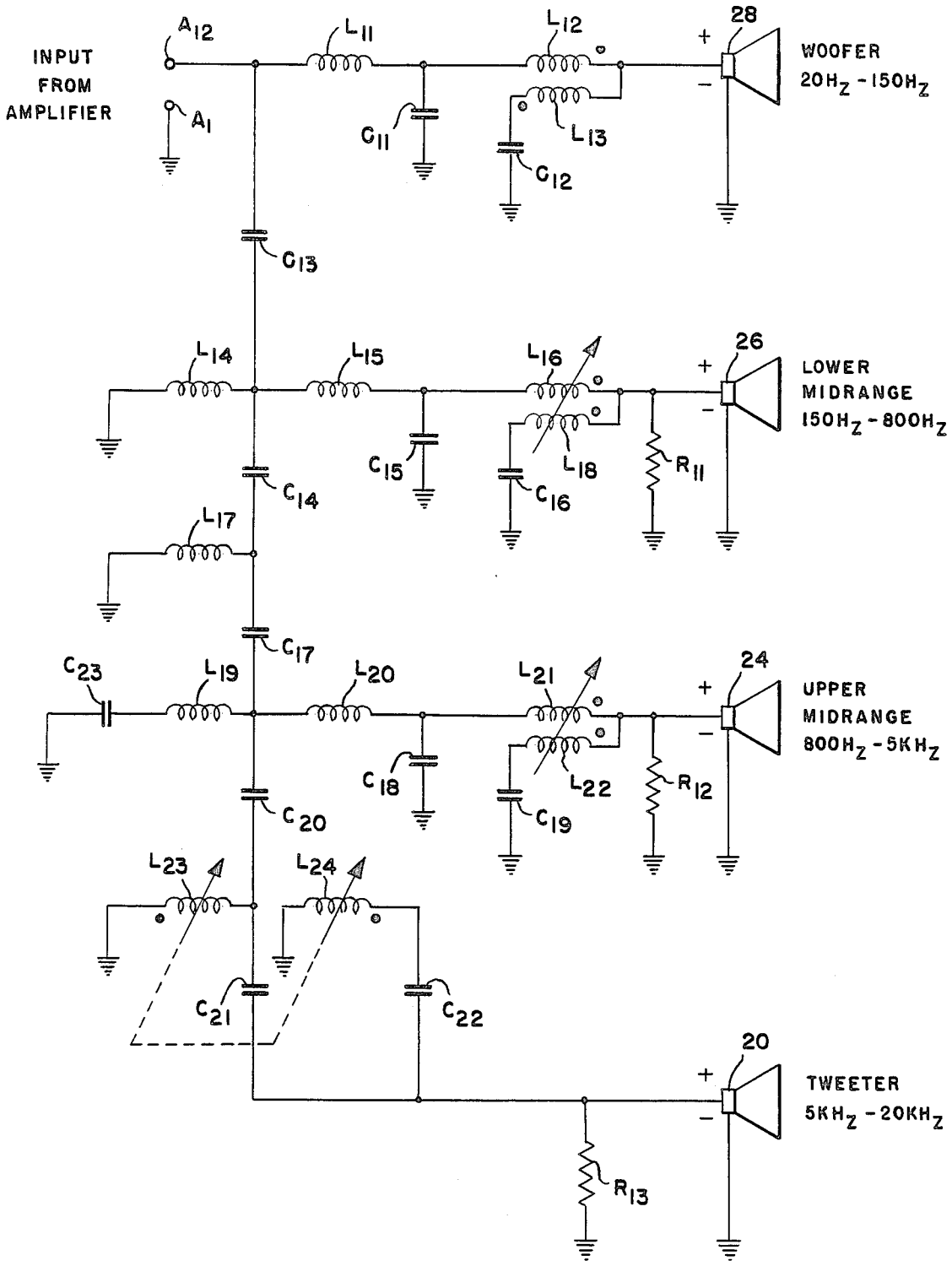
FIG. 10 is a circuit diagram illustrating a passive embodiment of the invention with improved performance over that of FIG. 3.
Figure 16A:
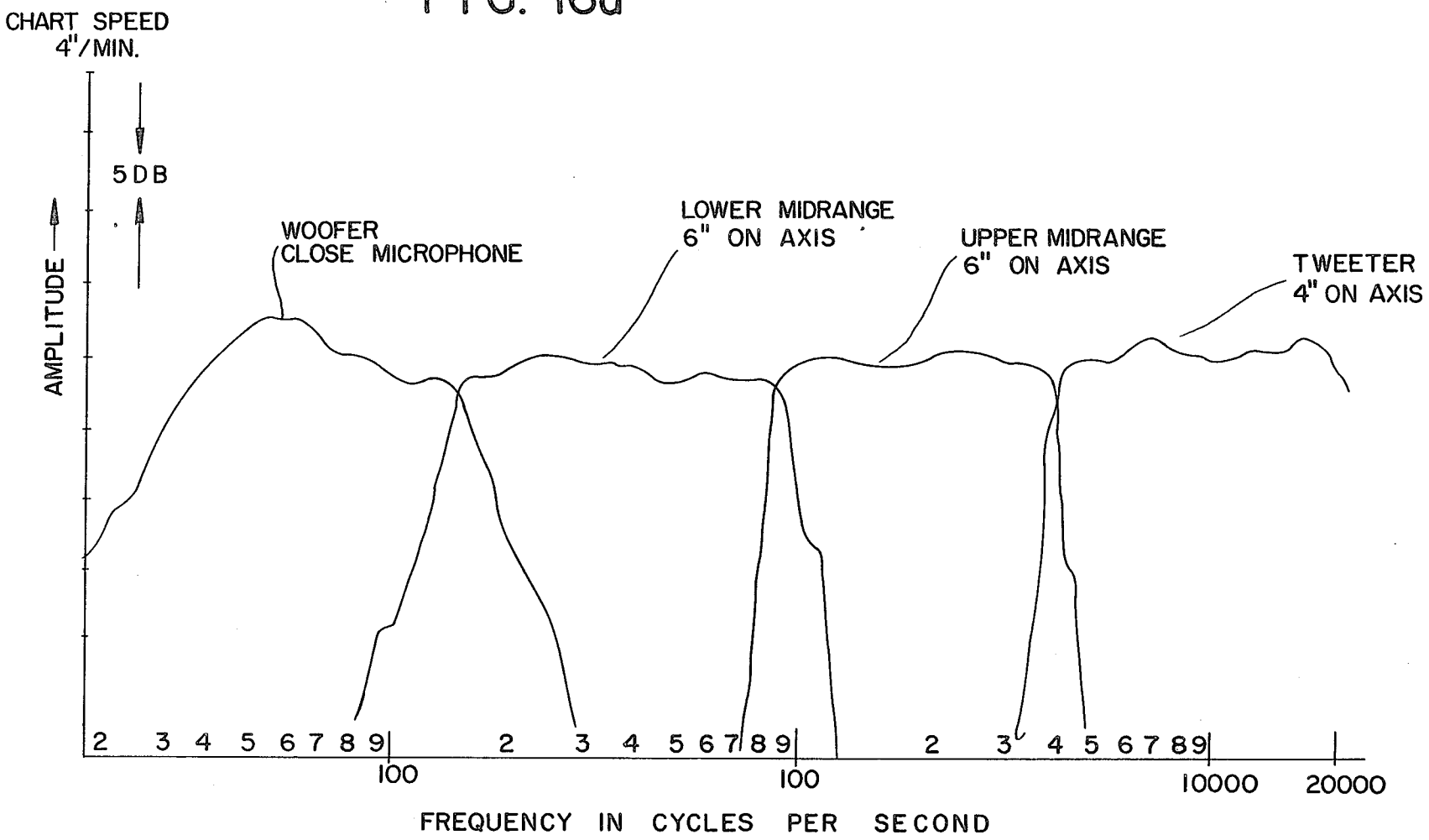
FIG. 16(*a*) illustrates the amplitude response of the individual drivers of the embodiment shown schematically in FIG. 10.
Figure 16B:
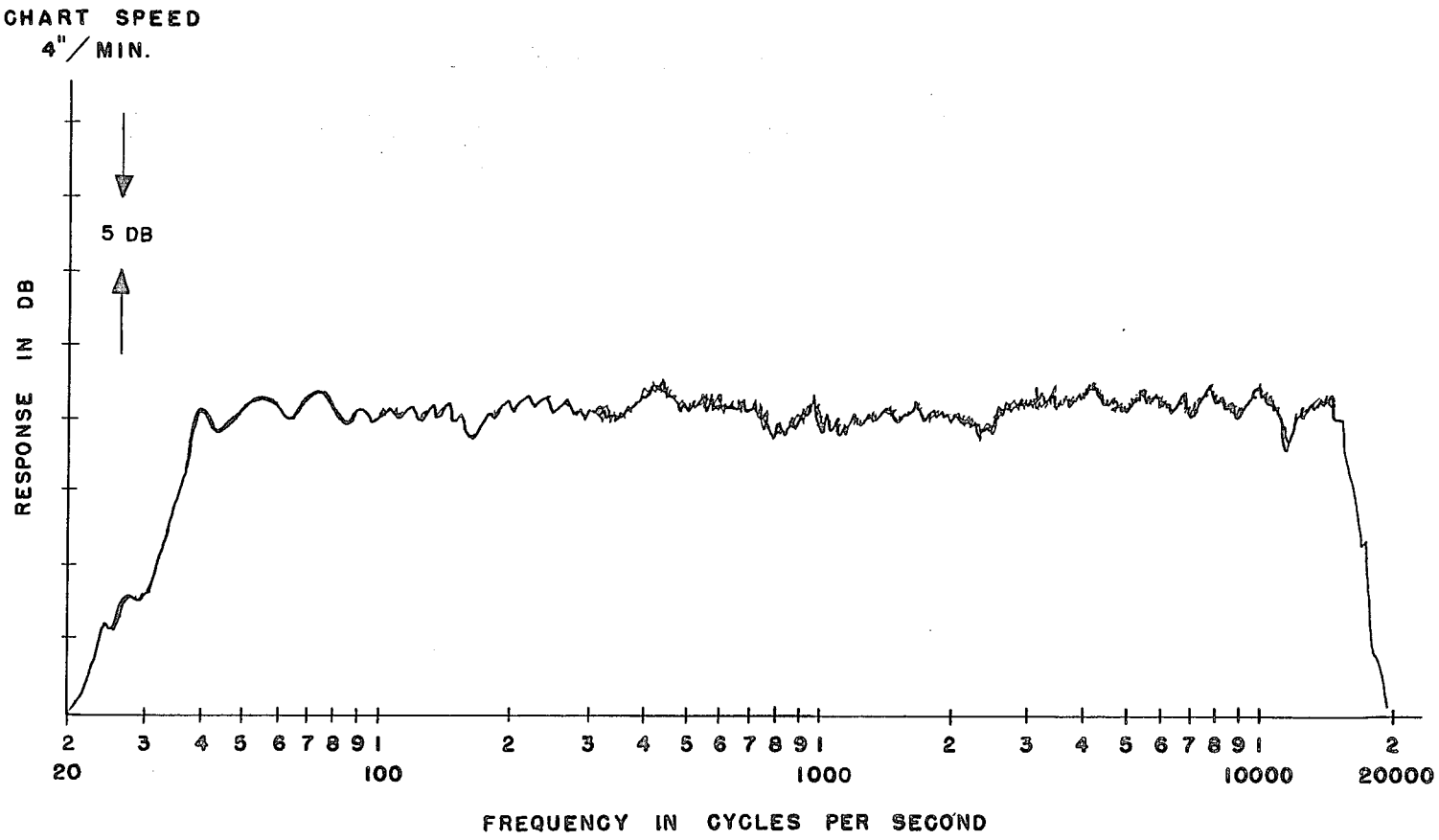
Figure 16C:
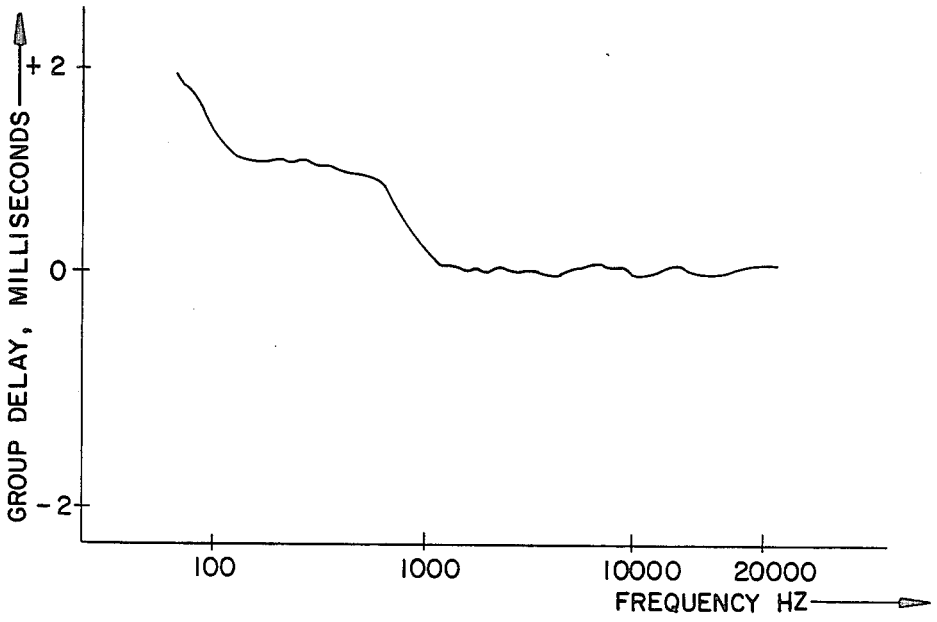

An embodiment of the invention with improved performance over that of FIG. 3 is shown schematically in FIG. 10. Amplitude response of individual drivers within the system is shown in FIG. 16(*a*). Overall amplitude response of the entire system is shown in FIG. 16(*b*). It is clear that the crossover passband slopes are steeper than those of FIG. 7 while the frequency overlap between adjacent passbands is reduced in FIG. 16(*a*) over that of FIG. 7. The embodiment shown schematically in FIG. 10 functions better than that of FIG. 3 in fulfilling the intent of this invention, according to statements 1.4 through 1.6 inclusive as set forth hereinbefore.

Figure 15A:
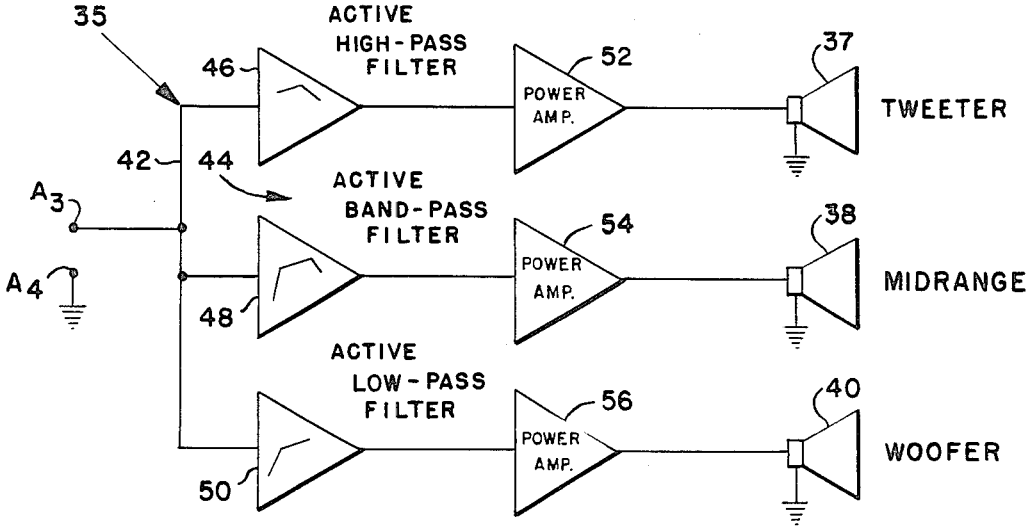
FIG. 15*a* is a circuit diagram illustrating an active circuit embodiment of the invention.
Figure 15B:
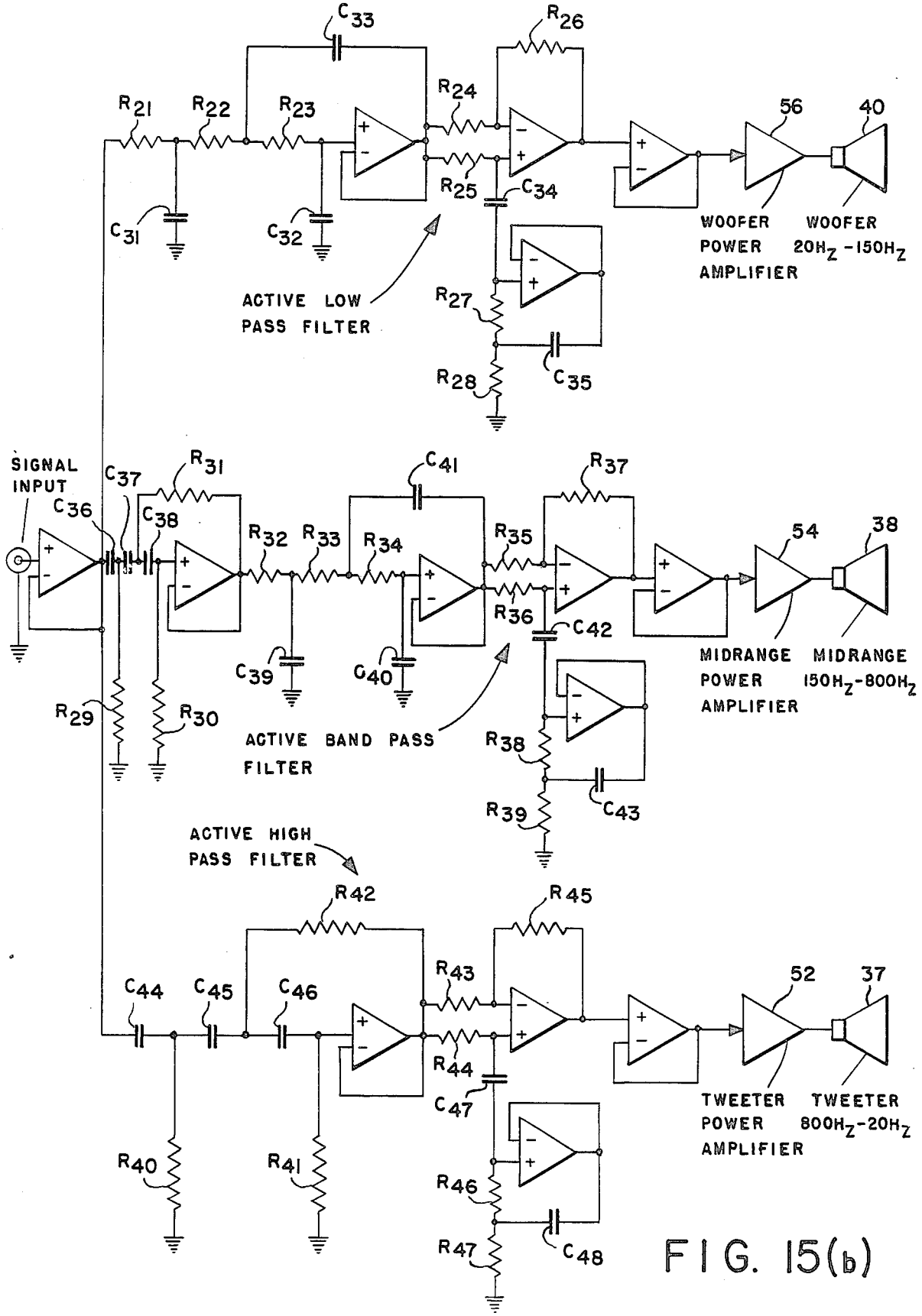
FIG. 15*b* is a circuit diagram illustrating an active circuit embodiment of the invention in detail.
Figure 17A:
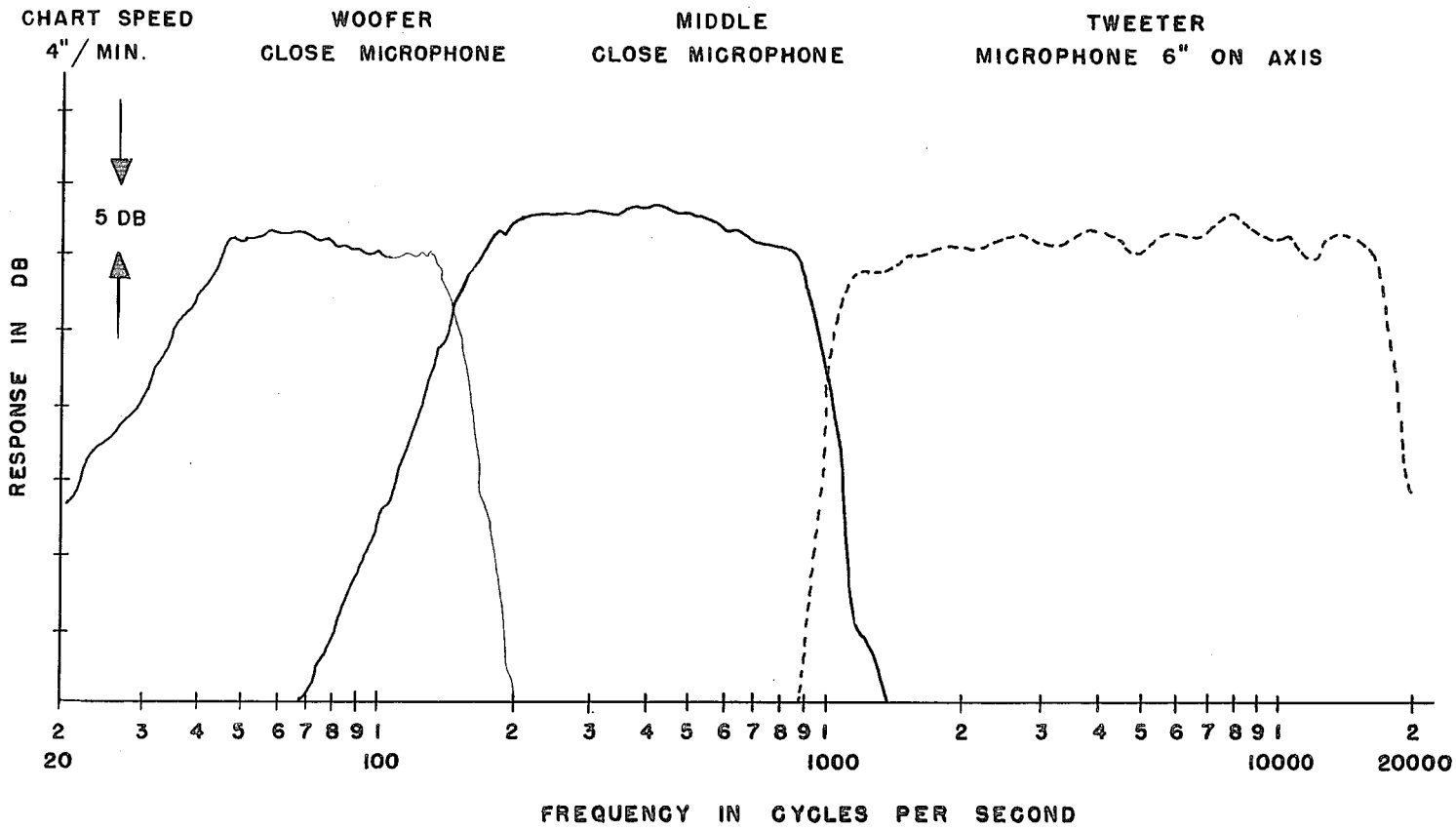
FIG. 17(*a*) illustrates the amplitude response of the individual drivers of the active embodiment shown schematically in FIG. 15*b;*
Figure 17B:
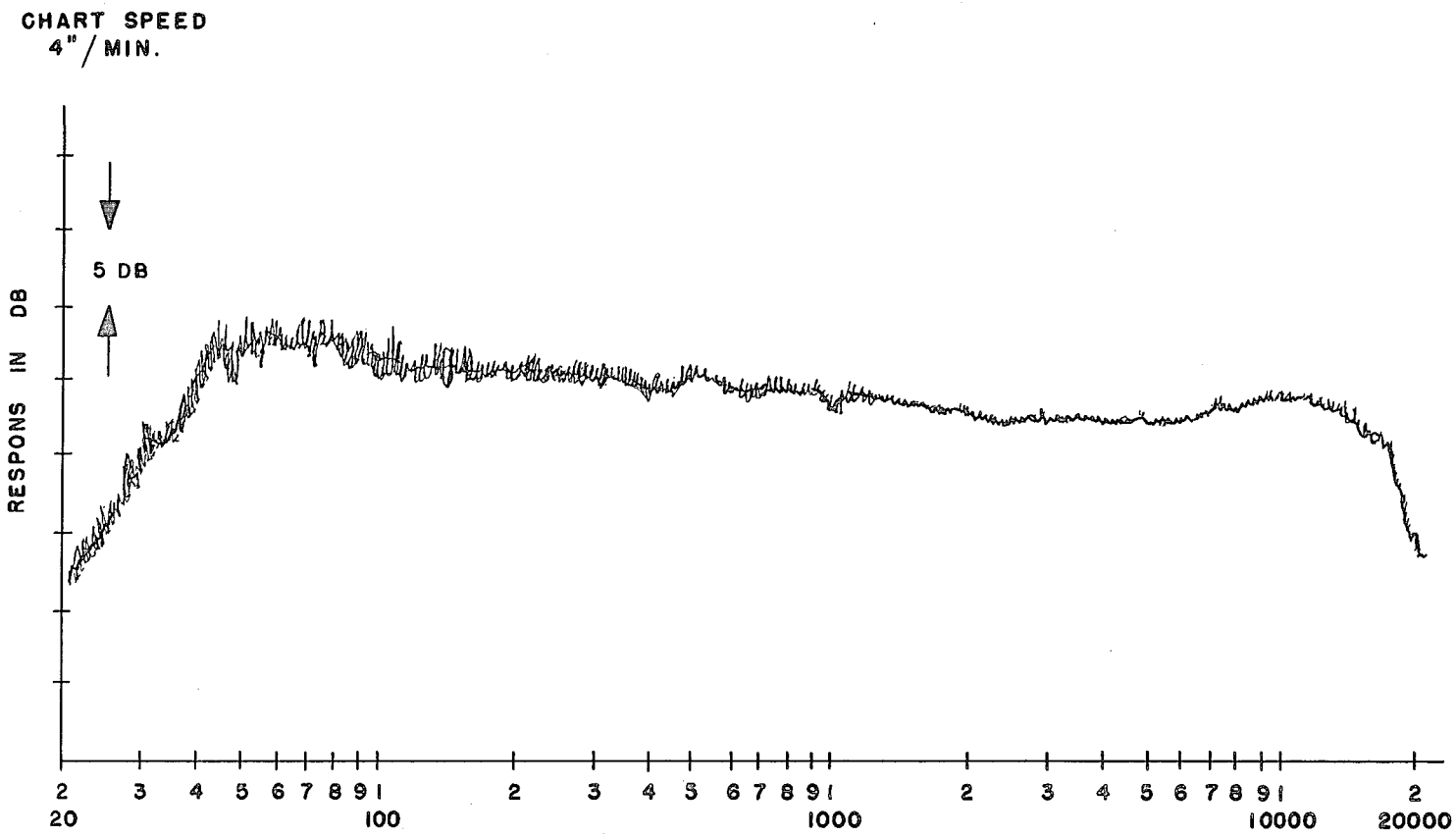
Figure 19A:
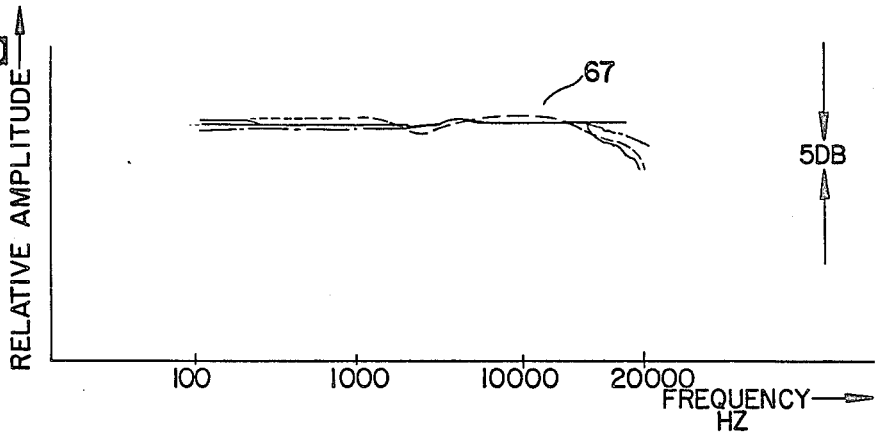
FIG. 19(*a*) illustrates the amplitude vs. frequency response for the FIG. 10 embodiment of the invention for response measurements taken using different positions for the test microphone.
Figure 19B:
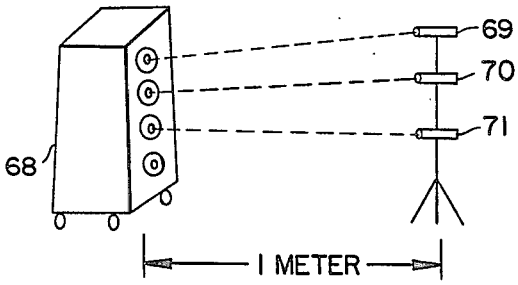
Figure 19C:
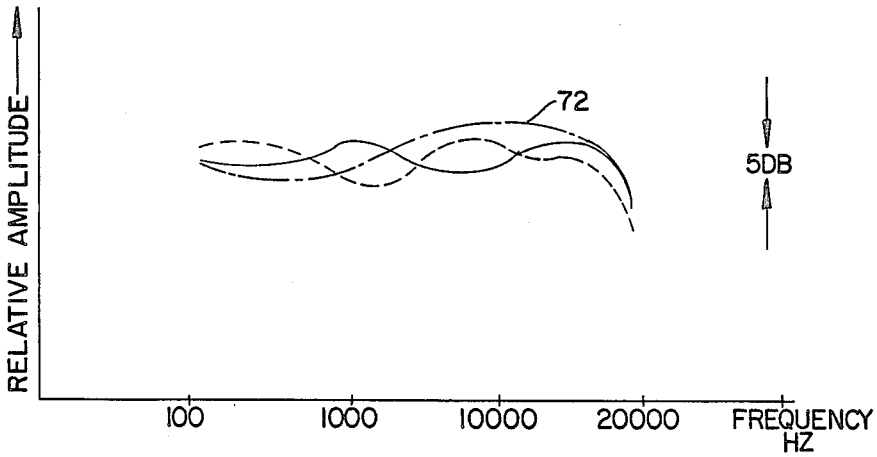
Figure 19D:
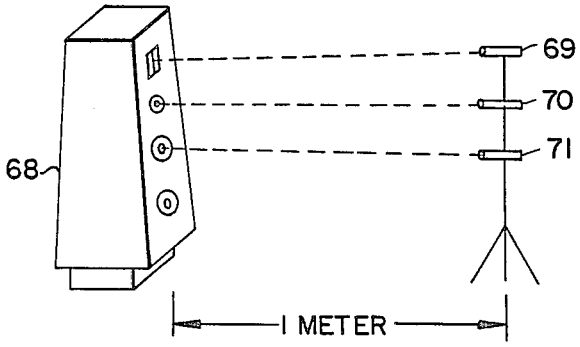

An active embodiment of the invention with performance superior to that of the passive embodiment of FIG. 10 is shown schematically in FIGS. 15*a* and 15*b*. Amplitude response of individual drivers within the system is shown in FIG. 17(*a*). Overall amplitude response of the entire system is shown in FIG. 17(*b*) It is clear that the crossover passband slopes are steeper than those of FIG. 10, while the frequency overlap between adjacent passbands is reduced in FIG. 17(*a*) over that of FIG. 10. Although the active embodiment of FIGS. 15*a* and 15*b* of the invention do outperform the two abovementioned passive embodiments of FIGS. 3 and 10, it should be noted that the active embodiment is one of greater complexity. The circuitry used in active embodiments of the invention will be briefly described.

In the circuit diagram on FIG. 15*a* there is illustrated an active circuit embodiment 35 of the present invention including a tweeter 37, a midrange driver 38, and a woofer 40. Electrical signals representing sound to be reproduced appear at the output terminals $A_3$ and $A_4$ of a component (not shown) such as an amplifier. The terminal $A_3$ is connected to the conductor 42 of a loudspeaker crossover circuit or filter network 44. Conductor 42 is common to the active high-pass, band-pass and low-pass filters or circuit means indicated at 50, 48 and 46 respectively, each of which limits the frequency range of the signals passing therethrough. Filters 46, 48 and 50 may comprise suitable electronic devices such as operational amplifiers incorporating the crossover p-z, as described hereinbefore, of the present invention for the tweeter 37, midrange driver 38, and woofer 40. As shown, a separate power amplifier 52, 54 and 56 is provided for amplifying the output of a respectively associated filter 46, 48 and 50. The outputs of amplifiers 52, 54 and 56 are applied, respectively, to the tweeter 37, midrange driver 38 and woofer 40.

FIG. 15*b* illustrates the circuitry of FIG. 15*a* in detail. The design and method of operation of active filter circuits to realize any p-z are sufficiently well explained, for those skilled in the art, in the reference *Handbook of Operational Amplifier Circuit Design*, by David F. Stout and edited by Milton Kaufman, McGraw-Hill, 1976.

The phase response of the invention embodiments of FIGS. 10 and 15*a* and 15*b* can be shown by phase and time measurements familiar to those skilled in the art to fulfill the intent of the invention as contained in the idea statement 1.8. Acoustical measurements taken on the aforementioned embodiments show all drivers operating in the same relative phase at the crossover frequencies with, at most, phase rotations of $2n\pi$ radians. Translated to delay error, this phase shift never exceeds a maximum delay error of one millisecond, for frequencies above 175 Hz. Delay response for one preferred invention embodiment, that shown in FIG. 10, is given in FIG. 16(*c*).

It should also be noted that as a result of steeper crossover filter passband band-edge slopes, the improved invention embodiments, especially those of FIGS. 10, 15*a*, and 15*b* will possess small wave interference between drivers operating on adjacent frequency bands. Acoustical researchers have not determined a precise value of such aforementioned wave interference at which its audible effects become objectionable. However, it will be evident to those skilled in the art that the present invention allows the level of wave interference to be reduced arbitrarily to a level such that drivers on adjacent frequency bands can be considered to radiate sound energy independently of each other, that is, the wave interference is rendered to be, at most, just barely audible.

Acoustical researchers are not in agreement as to the definition of audibly objectionable wave interference with respect to the sound radiated from a multi-driver loudspeaker system. This inventor has experimentally determined that if the "overlap", defined immediately hereinafter, in amplitude responses at the −10 dB points of loudspeaker drivers sharing a common crossover frequency is greater than $\frac{1}{3}$ octave, the interference becomes audible, and thus, objectionable.

Figure 18:
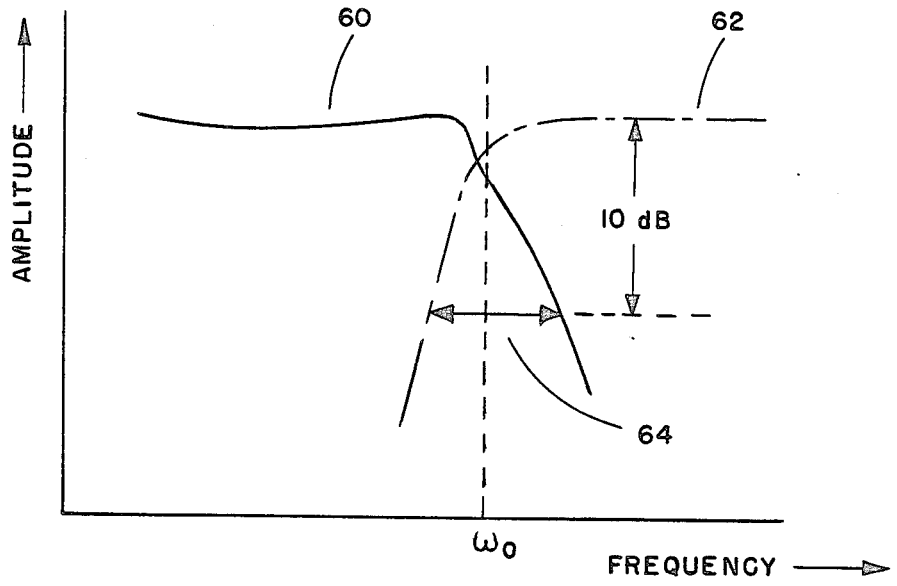
FIG. 18 illustrates a means whereby the acoustic wave interference between drivers operating on adjacent frequency bands may be quantized.

FIG. 18 illustrates the definition of acoustic wave interference. The amplitude responses 60 and 62 of two drivers sharing a common crossover frequency $W_o$ are shown. The overlap region shown at 64 becomes just barely audible at a point 10 decibels below the flat portions of the amplitude responses 60 and 62. If this width of the same overlap region shown at 64 in FIG. 18 is greater than $\frac{1}{3}$ octave, centered on the crossover frequency $W_o$, the acoustic wave interference is arbitrarily, but necessarily, considered by the inventor to become objectionable.

Acoustic wave interference effects in multidriver loudspeaker systems are related to the steepness of the filter passband band-edge amplitude vs. frequency response slopes. Throughout this specification, those skilled in the art should readily understand that these band-edge slopes actually define the attenuated drop-off from the filter's flat range of frequencies over which substantially no attenuation occurs. If the aforementioned slopes, shown at 65 and 66 in FIG. 18, become steeper, the width of the overlap shown at 64, which is a measure of the energy causing acoustic wave interference, will decrease. Slopes in excess of 40 dB/octave will result in an overlap, shown at 64, of less than $\frac{1}{3}$ octave in typical operative invention embodiments, with acoustic wave interference being just barely audible. This would yield acceptable performance for an operative invention embodiment. Slopes greater than 70 dB/octave, and approaching 100 dB/octave as in the better embodiments, result in inaudible acoustic wave interference, with superior performance, as the width of the overlap region, shown at 64 in FIG. 18, becomes much less than $\frac{1}{3}$ octave, too narrow for the human ear to perceive.

The separate crossover filter-loudspeaker driver combinations comprising an invention enbodiment, which share a common crossover frequency, for which typcial amplitude vs. frequency responses in the crossover region are illustrated in FIG. 18, will be defined as functioning "effectively" independently of each other, if the acoustic wave interference becomes just barely audible. This will correspond to crossover filter passband band-edge amplitude vs. frequency response slopes of about 40 dB/octave, and up to about 70 dB/octave.

The aforementioned crossover filter-loudspeaker driver combinations will be defined as functioning "absolutely" independently of each other, if the acoustic wave interference becomes inaudible. This will correspond to crossover filter passband band-edge amplitude vs. frequency response slopes equal to or greater than about 70 dB/octave.

In either of the aforementioned situations for "effective" or "absolute" independence, the separate crossover filter-loudspeaker driver combinations will comprise an operative invention enbodiment and will be considered to function independently of each other, without qualification, since the lesser condition of effective independence, defined hereinbefore, describes an acceptable or useful invention embodiment. The aforementioned distinction between effective and absolute independence is made merely in order to distinguish between "acceptable" and "superior" invention embodiments, respectively. In summary, an operative or useful embodiment of the present invention will exist, if at least at one system crossover frequency, and preferably at all system crossover frequencies if more than one such crossover frequency exists, the width of the overlap region shown at 64 in FIG. 18 is, at most, $\frac{1}{3}$ octave, which will correspond generally to a crossover filter passband band-edge amplitude vs. frequency response slope of about 40 dB/octave.

Acoustic wave interference effects in multidriver loudspeaker systems cause the timbral balance, or "sound quality" of a single, or monophonic speaker system to vary as the listener moves about in the room in which the speaker system is sounding. There will exist a different amplitude vs. frequency response for each and every listening position in the room. For a stereo pair of speakers, the aforementioned effect of acoustic wave interference still exists. In addition, acoustic wave interference within the individual speaker systems comprising a stereo pair will cause a blurring or "lack of focus" to the stereo image, because the accurate amplitude and phase information necessary to psychoacoustically reconstruct the stereo image becomes distorted by the same acoustic wave interference.

Sonic problems in loudspeaker systems caused by acoustic wave inteference are common knowledge to those familiar with the art. Designers of prior art loudspeakers have attempted to minimize the effects of acoustic wave interference in one of two ways:

(1) Elimination of the crossover network entirely, and devising loudspeaker systems which function by operating a single large loudspeaker driver or plurality of small loudspeaker drivers over the entire audio frequency range;

for example, in a speaker system presently marketed as the "901" by the Bose Corporation of Framingham, Mass., U.S.A., or, (2) Use of a conventional crossover system in the prior art as described hereinbefore taken together with physical location of the loudspeaker drivers comprising the total loudspeaker system having their acoustic centers as close together as practicable;

for example, as in a speaker system presently marketed as the "AR-9LS" by the Acoustic Research Corporation of Norwood, Mass., U.S.A.

The present invention presents a novel and superior crossover method, which rectifies the aforementioned sonic difficulties caused by acoustic wave interference; specifically those problems relating to timbral balance and stereo image. Loudspeaker systems embodying the present invention possess separate crossover filter-loudspeaker drive combinations which function independently of each other in their contribution to the total system acoustic output, thereby exhibiting negligible acoustic wave interference among the same crossover filter-loudspeaker driver combinations comprising the total loudspeaker system, thereby producing within the entire listening environment a very uniform amplitude vs. frequency sonic energy response, yielding both an accurate timbral balance and a clear and well-focused stereo image anywhere within the aforementioned listening environment. Also, as an added benefit from the present invention, mentioned hereinbefore in idea statements (1.4) and (1.6) and repeated here, sonic difficulties resulting from the transmittal of energy to loudspeaker drivers outside their respective frequency bands of best performance are eliminated.

FIG. 19 illustrates the superior performance of the present invention over prior art, with regard to the projection of a uniform amplitude vs. frequency sonic energy into the space in front of the loudspeaker system box, shown at 68. Due to the elimination of acoustic wave interference effects among the separate crossover filter-loudspeaker driver combinations comprising loudspeaker systems embodying the present invention, more specifically the invention embodiment schematically depicted in FIG. 10, this same invention embodiment exhibits nearly identical $\frac{1}{3}$ ocatve pink noise amplitude vs. frequency responses, shown at 67 in FIG. 19*a*, for three different positions of the test microphone, said positions being shown at 69, 70 and 71, for a box to microphone position of one meter. The same test results for a prior art loudspeaker system, of about the same size, shape, and cost of the aforementioned invention embodiment, namely the model "50" made by the Speakerlab Company of Seattle, Wash., U.S.A., is shown at FIG. 19(*c*). Variations in amplitude vs. frequency response of this same prior art system, shown at 72, for the aforementioned same three microphone positions, are clearly apparent.

Figure 20A:
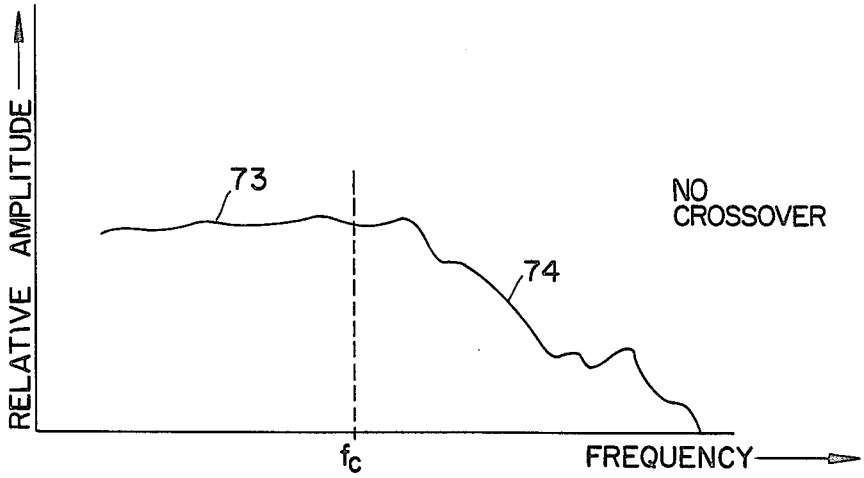
FIGS. 20(*a*), 20(*b*) and 20(*c*) illustrate, respectively, the amplitude vs. frequency response for (*a*) a loudspeaker driver that is not connected to a crossover filter network, (*b*) the same loudspeaker connected to a prior art crossover filter network, and (*c*) the same loudspeaker connected to a crossover filter network of the present invention.
Figure 20B:
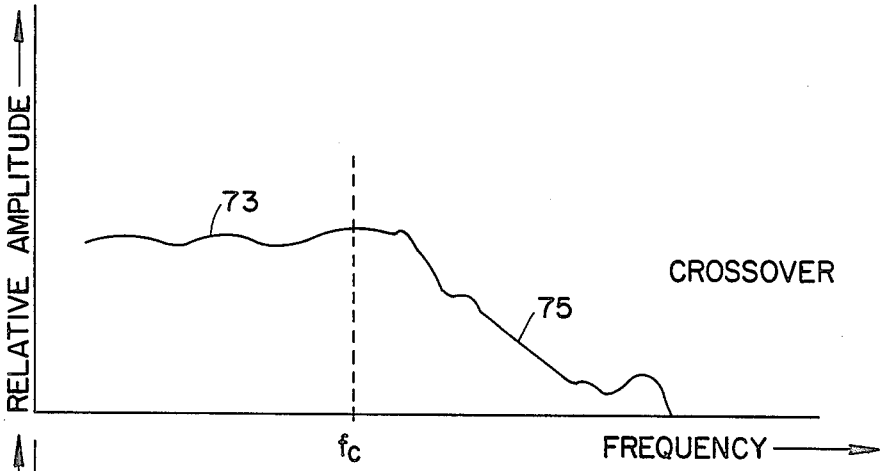
FIG.20b PRIOR ART
Figure 20C:
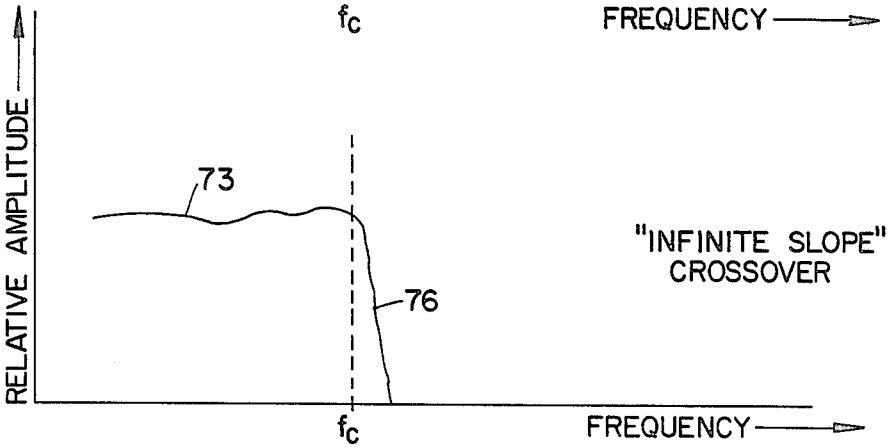

FIGS. 20(*a*), 20(*b*) and 20(*c*) illustrate the superior performance of the present invention over prior art, with regard to the reduction of loudspeaker driver performance deficiencies stated in idea statements (1.4) and (1.6). FIG. 20*a* shows the amplitude vs. frequency response for a high-quality $6\frac{1}{2}''$ bass-midrange driver when the same is operated over the entire audible frequency range without the use of a crossover filter. The frequency region of best or "ideal" driver performance is shown at 73. Above the frequency shown as $f_c$, cone breakup occurs, which is the main cause of the irregular frequency response shown at 74. Audibly unpleasant "sonic colorations" and high distortion occur in the same frequency region shown at 74, phenomena well known to those skilled in the art. FIG. 20*b* shows the amplitude vs. frequency response of this same 6½" driver when operated over the entire audible frequency range using a common prior art crossover filter topology, specifically a low-pass filter having a 6 dB/octave passband band-edge slope. The frequency region of best driver performance, shown at 73, is unaffected. The frequency region of poor driver performance, shown at 75, is clearly evident, and will be audible as sonic coloration and distortion. FIG. 20*c* shows the amplitude vs. frequency response of the same 6½" driver when operated over the entire audible frequency range but using "infinite-slope" low-pass filter topology of the present invention. The frequency region of best driver performance, shown at 73, is unaffected, but response in the frequency region of poor driver performance, shown at 76, is eliminated and rendered inaudible.

For those skilled in the art, it should become evident upon study of the amplitude responses of invention embodiments given here in FIGS. 7, 16 and 17 that the amplitude vs. frequency response shapes characteristic to the separate crossover filter-loudspeaker driver combinations of the present invention are much closer to the ideal brick-wall response shape, than exists in prior art. Thus the present invention will, by virtue of its unique "infinite-slope" crossover filter topology, improve over prior art, by permitting the mitigation of certain performance deficiencies in loudspeaker systems, namely the deficiencies caused by acoustic wave interference, and also deficiencies caused by operation of loudspeaker drivers at frequencies outside the same driver's respective frequency bands of best performance. The reader is especially referred to the prior art designs given in this disclosure in order to make the comparisons just implied.

By way of illustration and not limitation it is noted that the electrical parameters of the individual components of the invention embodiments depicted in FIGS. 10 and 15*b* are as follows:

1. Embodiment of FIG. 10:

| 1. Embodiment of FIG. 10: | | | |
|---|---|---|---|
| $L_{11}$ | 5.1 mh | $C_{10}$ | 470 microfarads |
| $L_{12}$ | 5.1 mh | $C_{11}$ | 220 microfarads |
| $L_{13}$ | 3.2 mh | $C_{12}$ | 100 microfarads |
| $L_{14}$ | 8.4 mh | $C_{13}$ | 100 microfarads |
| $L_{15}$ | 1.55 mh | $C_{14}$ | 16 microfarads |
| $L_{16}$ | 1.7 mh | $C_{15}$ | 36 microfarads |
| $L_{17}$ | 757 microhenries | $C_{16}$ | 16 microfarads |
| $L_{18}$ | 757 microhenries | $C_{17}$ | 14 microfarads |
| $L_{19}$ | 2.1 mh | $C_{18}$ | 10 microfarads |
| $L_{20}$ | 320 microhenries | $C_{19}$ | 3.3 microfarads |
| $L_{21}$ | 540 microhenries | $C_{20}$ | 3.0 microfarads |
| $L_{22}$ | 215 microhenries | $C_{21}$ | 1.0 microfarads |
| $L_{23}$ | 170 microhenries | $C_{22}$ | 1.68 microfarads |
| $L_{24}$ | 540 microhenries | $C_{23}$ | 24 microfarads |
| | | $R_{11}$ | 30 ohms |
| | | $R_{12}$ | 30 ohms |
| | | $R_{13}$ | 15 ohms |

2. Embodiment of FIG. 15*b*:

| 2. Embodiment of FIG. 15b: | | | |
|---|---|---|---|
| $R_{21}$ | 10k ohms | $C_{31}$ | 0.13 microfarads |
| $R_{22}$ | 10k ohms | $C_{32}$ | 0.033 microfarads |
| $R_{23}$ | 10k ohms | $C_{33}$ | 0.16 microfarads |
| $R_{24}$ | 22k ohms | $C_{34}$ | 0.0016 microfarads |
| $R_{25}$ | 22k ohms | $C_{35}$ | 1.27 microfarads |
| $R_{26}$ | 22k ohms | $C_{36}$ | 0.127 microfarads |
| $R_{27}$ | 10k ohms | $C_{37}$ | 0.127 microfarads |
| $R_{28}$ | 10k ohms | $C_{38}$ | 0.127 microfarads |
| $R_{29}$ | 7.2k ohms | $C_{39}$ | 0.051 microfarads |
| $R_{30}$ | 50k ohms | $C_{40}$ | 0.0013 microfarads |
| $R_{31}$ | 2.8k ohms | $C_{41}$ | 0.22 microfarads |
| $R_{32}$ | 10k ohms | $C_{42}$ | 437 picofarads |
| $R_{33}$ | 10k ohms | $C_{43}$ | 0.343 microfarads |
| $R_{34}$ | 10k ohms | $C_{44}$ | 0.02 microfarads |
| $R_{35}$ | 22k ohms | $C_{45}$ | 0.02 microfarads |
| $R_{36}$ | 22k ohms | $C_{46}$ | 0.02 microfarads |
| $R_{37}$ | 22k ohms | $C_{47}$ | 1137 picofarads |
| $R_{38}$ | 10k ohms | $C_{48}$ | 0.89 microfarads |
| $R_{39}$ | 10k ohms | | |
| $R_{40}$ | 3.9k ohms | All operational amplifiers | |
| $R_{41}$ | 155k ohms | Signetics NE5534 or equivalent | |
| $R_{42}$ | 620 ohms | | |
| $R_{43}$ | 22k ohms | | |
| $R_{44}$ | 22k ohms | | |
| $R_{45}$ | 22k ohms | | |
| $R_{46}$ | 10k ohms | | |
| $R_{47}$ | 10k ohms | | |

THEORETICAL BASIS FOR THE INVENTION

It is believed that a better understanding of the function of the crossover circuits of FIGS. 3 and 10 (or other topologies based upon the concepts of the present invention) will be had upon an examination of the development of the characteristic p-z of the invention. A general reference that describes the p-z concepts utilized according to the present invention is *Circuit Theory and Design*, (pp. 168–173) John L. Stewart, John Wiley & Sons, Inc., New York, 1956. Other references that are pertinent with respect to the network analysis are *Network Analysis and Synthesis*, First Edition, (pp. 320 and 321) Franlin F. Kuo, John Wiley & Sons, Inc., New York, 1962; and *Linear Network Analysis*, (pp. 284 and 285) S. Seshu and N. Balabanian, John Wiley & Sons, New York, 1963.

A pole zero pattern or p-z as is illustrated in FIG. 11 would be those for a perfect realization of the invention. These are the p-z of Equation (6) below;

(See the abovementioned reference by Stewart, pages 96–97 and pages 168–172; see also Seshu and Balabanian, page 284 FIG. 27).

$$f_4(s) = \frac{e^{-sU}}{e^{+sT}} = \frac{1 - sU + (sU)^2/2! - (sU)^3/3! + \ldots}{1 + sT + (sT)^2/2! + (sT)^3/3! + \ldots} \quad (6)$$

Taken to infinity in both U and T, real positive constants, the above function will yield an infinite vertical row of poles in the left-half s-plane and an infinite vertical row of zeros in the right-half s-plane, as illustrated in FIG. 11. If the series in Equation (6) is terminated in a finite number of terms, with U=T, the following Equation (7) is obtained:

$$f_5(s) = \frac{e^{-sT}}{e^{+sT}} = e^{-2sT} = \frac{1 - st + (sT)^2/2! - (sT)^3/3!}{1 + sT + (sT)^2/2! + (sT)^3/3!} \quad (7)$$

which is a standard approximation to the all-pass transfer function with the series of Equation (6) terminated after three terms. If the zeros in Equations (6) and (7)

are omitted the function remains all-pass for an infinite expansion—Equation (6) becoming Equation (2)—and becomes low-pass for a finite truncation [Equation (7) without its zeros], both merely having half the delay at any frequency (see page 285 of the reference "Linear Network Analysis" referred to above). When the zeros of Equation (6) or (7) are removed, the earlier approximation based on Equation (2) is obtained:

$$f_0(s) = \frac{e^{-sT}}{1} = \frac{1}{e^{sT}} = \frac{1}{1 + sT + (sT)^2/2! + (sT)^3/3! + \ldots} \quad (2)$$

It is noted that Equations (6) and (2) are identical if U=T in Equation (6) except for the contant multiplier in the exponential. Both represent an all-pass transfer function, the addition of the right-half s-plane zeros in Equation (6) merely doubles the delay. Since Equations (2) and (6) above each represent an approximation to the ideal all-pass transfer function, then any linear combination of them could also approximate an all-pass transfer function. If a loudspeaker system is constructed such that its acoustical output may be represented mathematically by multiplying the electrical input by some linear combination of Equations (6) and (2), there will be obtained a good approximation to the ideal lousspeaker system. It is noted that Equation (5) represents the simplest possible such approximation. This invention considers a novel and more accurate approximation.

By means of the present invention, a system input-output transfer function is generated such that it may be broken apart, using a method analogous to a partial-fraction expansion, into separate low-pass, band-pass, and high-pass representations, said representations each being brick wall amplitude functions, the individual dominant p-z of which can be represented as a linear combination of finite forms of Equations (2) and (6). Stated in another manner, there is developed by means of the present invention an acoustic sum whose mathematical representation as a system function has the form:

$$\text{Acoustic output} = \text{electrical input} \times \frac{P(s)}{Q(s)} = G(s) \quad (8)$$

where the loudspeaker drivers are assumed ideal and which is equivalent to an approximation to an all-pass transfer function in linear combinations of truncations of Equations (2) and (6) whose quotient P(s)/Q(s) can be broken apart, similar to partial fractions, into two or more separate quotients of polynomials in s, each of which will take the form of the dominant p-z of a brick wall filter transfer function. These franctional expansions will take the following forms:

$$\text{2-way system } P_1(s)/Q_1(s) + P_2(s)/Q_2(s) \quad (9)$$

$$\text{3-way system } P_1(s)/Q_1(s) + P_2(s)/Q_2(s) + P_3(s)/Q_3(s) \quad (10)$$

where extensions to 4-way, 5-way, etc. systems may also be effected. In Equation (9) the terms $P_1(s)/Q_1(s)$ and $P_2(s)/Q_2(s)$ are arranged in such a manner that they represent the dominant p-z of a low pass and high pass filter, respectively. Similarly in Equation (10), $P_1(s)/Q_1(s)$ represents the dominant p-z of a low pass filter; $P_2(s)/Q_2(s)$ represents the dominant p-z of a band-pass filter; and $P_3(s)/Q_3(s)$ represents the dominant p-z of a high-pass filter.

It has already been shown by Equation (5) that a very simple loudspeaker system can be realized which satisfies Equation (9). It is noted also that extensions of this simple idea will satisfy Equation (1) and higher-order systems. All of the prior art designs, however, depend upon filter topologies that have gradual crossover slopes (6, 12, or 18 dB/octave in various combinations) which suffer from deficiencies (1.1, 1.2, 1.3) mentioned hereinbefore. Novel means are provided according to the present invention to mitigate these aforementioned deficiencies.

In accordance with the invention, a loudspeaker system is constructed with crossover filter circuits having very high passband band edge amplitude vs. frequency response slopes while generating an overall system transfer function having p-z in the forms implied by truncations of Equations (2) and (6). This is effectively done by the embodiments of the invention illustrated in FIGS. 3, 10 and 15. Basic characteristics of any embodiment of the invention, including those of FIGS. 3, 10 and 15, are as follows:

(1.9) The crossover filter passband band-edge slope is large; it may be as high as 100 dB/octave, or even higher.

(2.0) At least two loudspeaker drivers are used, and at least two separate mutually exclusive frequency bands are covered, i.e., one woofer and one tweeter comprise the simplest possible embodiment.

(2.1) The crossover filter passband slope and driver placement are adjusted so that wave interference between adjacent frequency bands is minimized by keeping the audibly effective band-width of any such interference to less than $\frac{1}{3}$ octave.

(2.2) The electrical parameters of the crossover are adjusted such that a fractional expansion of the system transfer function will appear as in Equation (9) or (10) or any higher-order extension of these. The denominator polynomials Q(s) will, in the best embodiments, have different poles, with no repeated (common) poles, which is characteristic to a class of separate and distinct brick-wall amplitude functions employing both mutually exclusive frequency passbands and transmission zeros.

(2.3) The electrical parameters of the crossover network, in the best embodiments, are so adjusted that all drivers in the loudspeaker system operate in the same relative phase, which allows phase rotations of $2n\pi$ radians at the crossover frequencies, in accordance with statement (1.8) hereinbefore.

When conditions (1.9) to (2.3) are met, an embodiment according to the invention is realized. Stated differently, when a loudspeaker system is constructed that satisfies condition (1.9) through (2.3), the p-z of its overall system transfer function will satisfy Equation (2) or Equation (6) or some linear combination of these.

A pictorial illustration of the p-z peculiar to a general embodiment of the invention will clarify how the concepts of conditions (2.1) to (2.3) are realized. FIGS. 12*a*, 12*b* and 12*c* show the dominant p-z for the low-pass, band-pass, and high-pass filter circuits respectively of an embodiment. The p-z at the origin and those having large negative real parts (depicted hereinbefore in FIGS. 6*a*, 6*b* and 6*c*; 5*a*, 5*b* and 5*c*; 4*a*, 4*b* and 4*c*, respectively) are ignored as they contribute little to the system response inside the pass band.

When the p-z in FIGS. 12*a*, 12*b* and 12*c* are summed, the result will have dominant p-z as shown in FIG. 12*d*. Since the poles of FIGS. 12*a*, 12*b* and 12*c* are simple and distinct, all of those poles appear in FIG. 12*d*. All dominant left hand plane zeros inside the system total pass band response, in any embodiment of the invention, will disappear in this summation.

Dominant right half plane zeros, if and as they occur in any embodiment, will not disappear and instead will always be accompanied by corresponding mirror image left hand plane poles. The simpler case, in which there are no dominant right half plane zeros, is treated in this discussion.

Figure 13A:
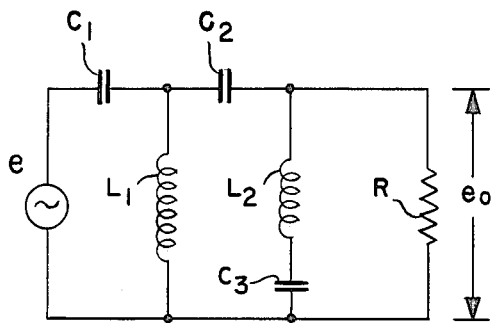
FIGS. 13*a* and 13*c* are circuit diagrams and FIGS. 13*b* and 13*d* are pole-zero plots used in a mathematical derivation of the p-z of tweeter and midrange networks similar to the embodiment of FIG. 3.

This concept may be depicted mathematically, as explained further hereinafter, but involves the use of certain expressions which will first be derived with reference to FIGS. 13*a* and 13*c* which respectively illustrate, in general, a tweeter network and a midrange network embodying the invention.

Figure 13B:
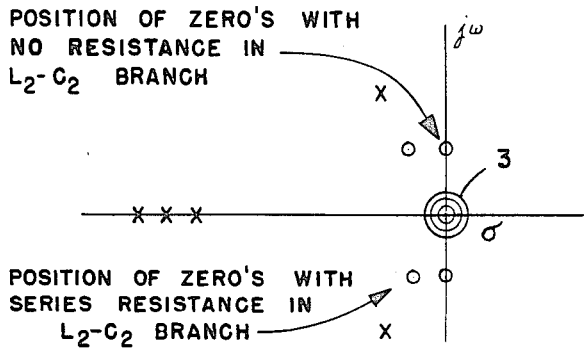

The following is a mathematical derivation for the p-z of the tweeter and midrange networks. The tweeter network is given as shown in FIG. 13*a* and has one zero of transmission placed about one octave below its pass band. Solving for the transfer function (output voltage vs. input voltage) of the network of FIG. 13*a*, yields, assuming no loss in the $L_2$-$C_3$ series circuit:

$$\frac{eo}{e} = \frac{L_1C_1C_2Rs^3(L_2C_3s^2 + 1)}{As^5 + Bs^4 + Cs^3 + Ds^2 + Es + F}$$

where the denominator coefficients do not appear explicitly as functions of the circuit elements; which has p-z as shown in FIG. 13*b*. It is noted by reference to FIG. 13*b* that with no resistance in the $L_2$-$C_3$ branch the zeros are positioned on the jw axis. On the other hand, with series resistance in the $L_2$-$C_3$ branch, the zeros are displaced to the left hand plane.

Figure 13C:
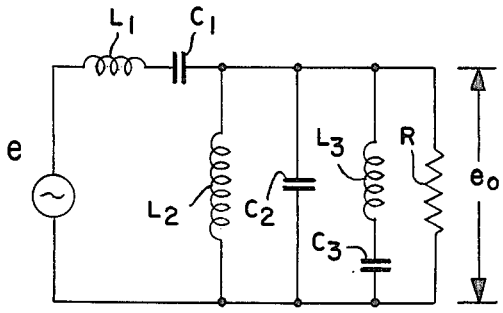
Figure 13D:
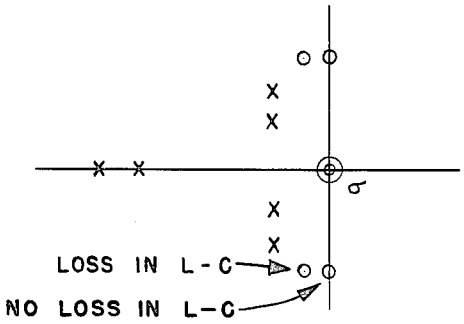

The midrange crossover network is given as shown in FIG. 13*c* and has one zero placed about ½ octave above its upper cutoff frequency. Solving for its transfer function as above yields:

$$\frac{eo}{e} = \frac{C_1s^2(As^2 + B)}{\gamma s^6 + Bs^5 + \alpha s^3 + \delta s^2 + \tau s}$$

which has p-z as is illustrated in FIG. 13*d*. It is noted that zeros appear in FIG. 13*d* on the jw axis with no series resistance in the L-C branch, corresponding to infinite band-edge slope. The zeros move to the left for real circuit elements having resistance, corresponding to finite band-edge slopes.

The concept that all dominant left hand plane zeros inside the system total pass band response will disappear in the summation, as noted above, is depicted mathematically as follows, where the following expressions are those obtained in the foregoing derivation.

Let $$\frac{e_o1}{e} = \frac{C_1s^2(As^2 + B)}{\text{(six poles)}}$$

represent the p-z of a band-pass (midrange) filter circuit of an embodiment of the invention.

Let $$\frac{e_o2}{e} = \frac{L_1C_1C_2Rs^3(L_2C_3s^2 + 1)}{\text{(five poles of } eo2)}$$

represent the p-z of a high-pass (tweeter) filter circuit of an embodiment of the invention. The poles of $e_o$1 and $e_o$2 will be assumed to be mutually exlcusive, i.e., no common factors.

It is desired to sum these transfer functions in such a manner as to realize the invention. The sum is formed as in Equation (11) below:

$$\frac{eo}{e} = \frac{eo1}{e} \pm \frac{eo2}{e} = \frac{\begin{array}{c} C_1s^2(As^2 + B) \\ \text{(Poles of } eo2) \pm \\ L_1C_1C_2Rs^3(L_2C_3s^2 + 1) \\ \text{(Poles of } eo1) \end{array}}{\text{Eleven poles of } eo1 \text{ and } eo2} \tag{11}$$

where choice of the plus or minus sign depends on the relative phase characteristics of the drivers.

A straightforward solution for the locations of the p-z in Equation (11), or in any other summation of the form of Equation (11) and peculiar to embodiments of this invention, is very difficult. Fortunately such a direct solution is not necessary. The essential disappearance of all dominant left-hand plane zeros in a summation of the form of Equation (11), and the consequent realization of the invention, is easily shown heuristically from simple energy considerations.

Refer to FIGS. 12*a*–12*d* and consider statement (2.4) below:

(2.4) Since each filter circuit of any embodiment of the invention has very steep passband amplitude vs. frequency response band-edge slopes, combined with mutually exclusive ranges or bands of frequency coverage, the energy at any given frequency in the total system transfer function can be considered to be sensibly contributed by one, and only one portion, i.e., crossover filter-loudspeaker driver combination (low-pass, band-pass, or high-pass) of the total system.

The only frequencies on the jw axis where the aforementioned statement becomes an approximation is in the small regions of frequency overlap at the crossover frequencies. Observe that if the invention were perfect—having infinite band-edge slopes—there would be no energy overlap at the crossovers and statement (2.4) would be absolutely true at all frequencies.

It can be shown that if statement (2.4) is true, and the total system frequency response is sensibly flat, as is the case in FIG. 8, there can be no dominant transmission zeros within the total system band pass. The heuristic proof that summations of the form of Equation (11) imply dominant p-z as in FIGS. 12*a*–12*d* is as follows: Consider the summation of Equation (11) and all the p-z involved in this summation FIGS. 14*a*, 14*b* and 14*c*). Here all the p-z are shown, not just the dominant ones. FIG. 14*c* contains all the poles of FIGS. 14*a* and 14*b*, which is fairly straightforward, as all these poles appear in the denominator of Equation (11). These poles must appear since each of them is a non-common factor of the least common denominator formed in the summation.

Proof of the existence of all of the zeros is a little less obvious. We proceed using an argument based on the aforementioned energy consideration (2.4) and an examination of the total system amplitude and phase response. Consider FIG. 14*a* in which we seek to evaluate the system amplitude and phase response at a point on the jw axis within the midrange pass band, say at $w_o$. The p-z at FIG. 14*a* imply that only the midrange driver is functioning in the total loudspeaker system, i.e., the woofers and tweeters are disconnected.

Now consider FIG. 14*c*. Here, the tweeter has been connected. There are now five more poles in the total system response. Two of these are a dominant complex-conjugate pair, which extends the system response into the high-frequency (tweeter) region. The remaining three poles are real and exist on the far left real axis, contributing almost nothing to the total system amplitude response. They must also not change the phase response, since we know from (2.4) that connecting the tweeter has no effect on the system midrange amplitude or phase response. Thus the total system zeros of our example Equation (11) must fall into positions which will guarantee that the midrange phase response, as well as the amplitude response, is the same with the tweeter in the system or out.

Examination of the numerator in Equation (11) shows that an $s^2$ is common throughout, implying two zeros at the origin. The highest order of s in the numerator is eleven, so there are nine more zeros to account for. The positions of these remaining nine zeros cannot be explicitly found without expanding and factoring the numerator of (11). But we do know enough to determine their approximate locations by induction.

What we do know about the zeros can be summarized as follows:

(2.5) None of the zeros are dominant, i.e., they cannot exist near the jw axis within the total system pass band.

(2.6) The zeros exist in positions such that the phase response defined within the individual pass bands of FIGS. 14*a* and 14*b* remain unchanged (ideally) in FIG. 14*c*.

A plausible set of locations for the remaining nine zeros is shown in FIG. 14*c*. The four transmission zeros which are dominant in FIGS. 14*a* and 14*b* move approximately horizontally to the left as in FIG. 14*c*, becoming no longer dominant. This supposed position of these zeros is supported by observation; for example, when one carefully measures the frequency response of an embodiment of the invention, very slight irregularities in amplitude of a fraction of a dB can be detected in the frequency response near the frequencies of the zeros.

The remaining five zeros are distributed near or on the negative real axis. They must occupy positions such that the phase response within the pass band of FIG. 14*c* is the same as that within the individual pass bands of FIGS. 14*a* and 14*b*. This may be confirmed by observation; in any embodiment of the invention total system phase shift is unchanged within any pass band when drivers associated with other pass bands are connected or disconnected. The aforementioned statement is exact if the crossover network frequency response band-edge slopes are infinite, and becomes approximate in the frequency band overlap of actual embodiments having non-infinite slopes.

REVIEW OF CONCEPTS UNDERLYING THE INVENTION

Thus, there has been established, by intuitive arguments supported by observation, the crucial concepts which underlie the operation of operative embodiments of the invention. These concepts may be presented as corollarys of statement (2.4):

(2.7) The separate portions, or crossover filter-loudspeaker driver combinations of the invention, (low-pass, band-pass, or high-pass), function independently of each other in their separate contributions to the total sytem acoustic output, whereby the degrees of "effective" or "absolute" independence are defined, as in FIG. 18 and the textual explanation of this figure given hereinbefore.

(2.8) The approximation to absolute independence among the same portions in (2.7) becomes more accurate as the crossover filter passband band-edge amplitude vs. frequency response slopes approach infinity. If the same band-edge slope becomes greater than about 70 dB/octave, acoustic wave interference becomes inaudible, and the acoustic outputs of the portions, or crossover filter-loudspeaker driver combinations in 2.7 are considered to be absolutely independent, as defined in FIG. 18 and the textual explanation of this same figure given hereinbefore.

Statements (2.7) and (2.8), taken together with statements (1.7) and (2.4), inclusive, mentioned hereinbefore, are characteristic to any embodiment of the invention, and serve to define its intent and operation. Summarizing the foregoing and showing how the invention improves upon the prior art systems, and specifically, how the present invention solves the difficulties mentioned hereinbefore, the following is noted with respect to statements (1.4) through (1.6), inclusive:

Statement (1.4): Well-designed loudspeaker drivers generally exhibit a band of frequencies in which the amplitude response is very flat, and in which the phase response is relatively linear. According to the invention, a driver is connected to a crossover filter circuit (1.8) having a "brick wall" passband characteristic corresponding to its frequency region of best performance. Energy is transmitted negligibly to the driver outside its frequency band of best performance, so that problems of irregular frequency and phase response—i.e., non-ideal behavior—originating from an individual driver are minimized.

Statement (1.5): Acoutic wave interference between drivers is caused by simultaneous radiation at the same frequency from two or more drivers, combined with spacing between the acoustical centers of the drivers of about one-half wave length or more. If the width of these frequency bands of simultaneous radiation, i.e., the overlap region shown at 64 in FIG. 18, is minimized, or reduced to zero, the same wave interference is correspondingly minimized or eliminated. The steep crossover filter passband slopes characteristic to this invention will minimize the width of these frequency bands of mutual interference to $\frac{1}{3}$ octave or less, with the width of these bands of mutual interference tending towards zero as the crossover slopes approach infinity.

Statement (1.6): Loudspeaker drivers tend to have low amplitude distortion only within their frequency bands of flat amplitude and linear phase response. Outside these bands, the distortion generally rises rapidly. Since the invention minimizes the energy transmitted to the drivers outside their frequency bands of best response, nonlinear distortion in the total system will be reduced.

Finally, mention is made of two crucial discoveries which clarify the nature of the invention. First, and most important, is the discovery that a good approximation to the ideal transfer response (1) can be realized by properly summing two or more "brick wall" amplitude functions having mutually exclusive frequency passbands lying adjacent to one another. By proper choice of system parameters, such as driver placement, type, the size, also crossover topologies, passbands and slopes, it is possible, by the methods of the invention, to achieve the aforementioned good approximation to the ideal system transfer function.

Also, observe that in forming the acoustic sum of the sound outputs of the individual drivers comprising the system, as for example, a sum in the mathematical form of Equation (9) or (10), in general, no poles or zeros disappear in the summation, as was shown explicitly in the single case described by Equation (11). This follows logically from Statement (2.2). Contrast this aforementioned situation with a speaker system based on concepts of which Equation (5) is the simplest example. Here, all p-z disappear! In general, prior art speaker designs have utilized acoustic summations which caused the disappearance of as many p-z as possible in the summation while tending towards some good approximation of Equation (1). According to the present invention, the opposite approach is taken; i.e., retaining all, or as many as possible, of the p-z of the individual elements in the final summation. This latter approach also approximates Equation (1) to a high degree of accuracy, while overcoming shortcomings of the prior art.

DESIGN EXAMPLE

There are two possible (but not necessarily all inclusive) design approaches one may take in the realization of loudspeaker systems using methods of the invention.

(1) Exact approach: The designer chooses the dominant poles of a system transfer function which approximates Equation (1) to the desired degree of accuracy. This involves picking as many terms in the infinite series of Equation (2) as desired, and is generally best realized as the p-z peculiar to a Bessel filter (Kuo, *Network Analysis and Synthesis*, p. 343–348). Then a loudspeaker crossover network with an acoustic summation implicit as the right-hand side of Equation (8) is designed to have dominant poles as near as possible to the aforementioned Bessel approximation. The arithmetic will be cumbersome and will require a computer program for an accurate solution. The p-z peculiar to the loudspeaker drivers themselves should be considered as part of the analysis, these p-z being either approximated for the drivers assumed as ideal, or either calculated or measured for the driver considered as non-ideal.

(2) Empirical approach: The designer chooses p-z of "brick-wall" amplitude functions which, based on previous experience, will yield a good (although not necessarily optimum) approximation to Equation (1) when an acoustic summation is performed as in Equation (8). Driver p-z may or may not be considered during the initial steps in the design. A prototype is then built and tested, and adjustments made to the crossover circuit components until the performance of the speaker system—in regard to the accuracy of its approximation to Equation (1)—is satisfactory. The inventor used this empirical approach in realizing the embodiments of the invention discussed herein.

Empirical methods were used for design of the invention embodiments schematically depicted in FIGS. 3, 10 and 15. Passive crossover filter circuits, i.e., as shown in FIGS. 3 and 10, were realized by utilizing an empirical extension of the well-known "image-parameter" method, described hereinafter. The active crossover filter circuit of the embodiment shown in FIG. 15 was realized by first determining the circuit element values using methods of the text *Handbook of Operational Amplifier Circuits Design* mentioned hereinbefore, and then empirically adjusting said circuit element values for optimum performance. To illustrate the procedure for making an operative embodiment of the invention more clearly, it will be treated in some detail in the following.

An empirical method was used to realize a preferred embodiment of the invention schematically depicted in FIG. 10. Numerical values for inductive and capacitative circuit elements comprising the crossover filter circuits of the aforementioned invention embodiment are calculated by use of the well-known "image parameter" method, which is described fully in the text *Electrical Engineering Circuits*, by H. H. Skilling, John Wiley & Sons (1957), Chapters 18 and 19. Tables of equations, amplitude and phase response graphs, schematic diagrams for filter circuit portions, and design aids for the image-parameter method are given in many reference books, one of which is *Reference Data for Radio Engineers*, Fourth Edition, Stratford Press (1963), Chapter 6.

As mentioned hereinbefore, the present invention is based upon the discovery by the inventor that a good and useful approximation to the ideal transfer function of Equation (1) can be realized by properly summing two or more brick-wall amplitude functions having separate and mutually exclusive frequency passbands which passbands when taken together encompass the entire audible frequency range. Furthermore, the inventor has discovered that ordinary image-parameter theory, augmented by empirical methods, may be used to realize suitable brick-wall amplitude functions for crossover network filters used in operative invention embodiments.

Design of an "infinite-slope" loudspeaker system begins with the selection of proposed loudspeaker drivers. Two or more of the same are needed in order to cover the audible range of frequencies, i.e., 20 Hz to 20 kHz. Selection of the number of drivers required is based upon considerations of the cost and size of the prospective loudspeaker system. For the invention embodiment of FIG. 10, four loudspeaker drivers are chosen, one woofer, two midranges, and one tweeter. Amplitude and phase measurements are made on all available and known drivers; from these, drivers are chosen which have performance, with respect to their amplitude and phase response, which can be considered to be ideal over separate frequency ranges which when taken together will encompass the entire audible frequency range. These frequency ranges for the four drivers chosen appear in FIG. 10 and also hereinafter.

Crossover network filters having brick-wall amplitude response characteristics are synthesized to possess passbands matching the frequency ranges of best performance of the aforementioned drivers. This is accomplished using enhanced image-parameter theory. If transmission zero frequencies, mutual coupling of coils, and filter passbands are chosen and adjusted properly, the acoustic sum, i.e., the total acoustic amplitude and phase response, of the invention embodiment will become an accurate approximation to the ideal transfer function of Equation (1).

The empirical design procedure begins with computation, using image-parameter methods, of initial crossover network circuit element values. Calculations for four separate passbands are required, i.e., the crossover network will have four separate filter circuits. Each filter circuit will need at least one transmission zero, in this case, six transmission zeros are incorporated into the crossover network filter topology, one zero each for the woofer low-pass filter and tweeter high-pass filter, and two zeros each for the two separate midrange band-pass filters. Frequencies for filter passbands and transmission zeros are tabulated as:

| DRIVER | PASSBAND | TRANSMISSION ZERO(S) |
|---|---|---|
| woofer | low - pass 20–150 Hz | 280 Hz |
| lower midrange | band - pass 150–800 Hz | 80 Hz<br>1450 Hz |
| upper midrange | band - pass 800 Hz–5 kHz | 550 Hz<br>6000 Hz |
| tweeter | High - pass 5 kHz–20 kHz | 3000 Hz |

In the above table frequency ranges for the crossover filter passbands correspond to the respective driver frequency ranges of best performance. Frequencies for the transmission zeroes are determined by intuition based upon past experience in working with the invention. Using the data tabulated hereinbefore, image-parameter methods are used to calculate initial circuit element values. Two sets of illustrative calculations are shown:

1. low-pass response for lower midrange driver:

$$f_c = 150 \text{ Hz impedance} = 8 \text{ ohms}$$

$$C_{13} = \frac{1}{w_c R} = \frac{1}{(2\pi)(150)(8)} = 132\ \mu f$$

$$L_{14} = \frac{R}{w_o} = \frac{8}{(2\pi)(150)} = 8.48\ mh$$

2. lower transmission zero for upper midrange driver:

$$f_c = 800 \text{ Hz } f_\infty = 550 \text{ Hz Impedance} = 8 \text{ ohms}$$

$$m = \sqrt{1 - f_\infty^2/f_c^2} = \sqrt{1 - (550)^2/(800)^2} = 0.726$$

$$L_{19} = \frac{L_k}{m} = \frac{R}{w_c m} = \frac{8}{(2\pi)(800)(.726)} = 2.19\ mh$$

$$C_{23} = \frac{m}{1 - m^2} C_k = \frac{m}{1 - m^2} \cdot \frac{1}{w_c R} =$$

$$\frac{.726}{(1 - .726^2)} \cdot \frac{1}{(2\pi)(800)(8)} = 38.1\ \mu f$$

It should be noted that some initial circuit element values as just calculated will change later after empirical adjustments. For example, $C_{13}$ became 100 $\mu$f and $L_{14}$ became 8.4 mh in the final circuit (FIG. 10), representing a slight change after empirical adjustments. One component in the design required a large change; $C_{23}$ calculated above as 38.1 $\mu$f became 24 $\mu$f in the final circuit (FIG. 10). All circuit element values given in the table hereinbefore for FIG. 10 represent the final empirically adjusted circuit element values for the same invention embodiment.

Calculations for the remaining circuit element values will not be shown here, but proceed in a manner similar to that just illustrated, except for resistive elements $R_{11}$, $R_{12}$, and $R_{13}$, which were determined purely empirically. These resistors serve to damp the efficiency of the three higher frequency drivers, matching the efficiency of the same to that of the woofer, such that all four drivers will sound with equal loudness, thereby producing a flat total system amplitude response.

After computation of all reactive circuit element values, and selection of the damping resistors for the higher frequency drivers, the crossover circuit is constructed, using components and techniques common to the art. Mutual coupling of some coil pairs is used where it has been empirically found to enhance the steepness of the passband band-edge response. This same mutual coupling of coil pairs is achieved by methods common to the art; including winding the two coils on a common iron core, or winding the two coils on separate cores and then mounting them physicially close together so their magnetic fields interact to provide mutual coupling.

The completed crossover network along with the loudspeaker drivers is assembled in a cabinet or box, in a manner common to the art, i.e., with the crossover network mounted inside the box, the drivers arranged physically close together in a vertical array on the front face of the box, and suitable electrical connections being made between the crossover network filter circuits and the respective loudspeaker drivers, and a pair of input terminals provided for connection of the loudspeaker system to a driving signal.

Amplitude, phase and delay measurements are made on the completed speaker system, and the crossover circuit reactive and resistive element values together with the mutual coupling of coil pairs are empirically adjusted until the system performance with respect to amplitude, phase, and delay response is, as recognized by those skilled in the art, an accurate and superior approximation to either form of the ideal delay function of Equation (1).

More specifically, part of the acoustical test procedure during empirical optimization and final evaluation of an invention embodiment makes use of the well-known "fast fourier transform" method. This same method employs a digital computer to analyze the time domain impulse response of a loudspeaker system. Software is used by this same method to produce the usual frequency domain amplitude, phase, and delay spectra from the time domain impulse signal response of the loudspeaker system under test. The aforementioned computer-produced spectra of amplitude, phase, an delay resonse are then confirmed by further measurements made directly in the frequency domain, using sine-wave and "pink-noise" test signals, together with wave analysers, AC voltmeters, oscilloscopes, and chart recorders, in a manner common to the art.

SUMMARY AND CONCLUSION

Thus, there has been provided, according to the invention, a method of and a means for reproducing by a loudspeaker system sounds from electrical signals representing sounds to be reproduced. A plurality of crossover filter circuits are provided to separate such signals into bands of different frequencies, there bei.ng established for each of the crossover filter circuits very high passband band-edge frequency response slopes by means of transmission zeros appropriately placed at frequencies just outside the pass bands of the individual filter circuits while simultaneously insuring that all or as many as possible of the dominant poles of the individual crossover filter circuits remain in the acoustic summation. This insures that each of the individual crossover filter circuits will possess a brick-wall amplitude vs. frequency characteristic so that as the same filter circuits direct electrical energy to their respective loudspeaker drivers over the frequency ranges of best performance of the same loudspeaker drivers, each of the individual crossover filter - loudspeakers driver combinations so formed will function independently of each other in their separate contributions to the total loudspeaker system acoustic output. This same independence is characteristic to operative embodiments of the present invention, in which embodiments by virtue of this same aforementioned independence the acoustic output of any one crossover filter - loudspeaker driver combination will not audibly impinge upon the acoustic output of any one another crossover filter-loudspeaker driver combination, as implied in idea statements (2.4), (2.7), and (2.8) given hereinbefore, thereby enhancing, by means of the present invention, the fidelity of response in the reproduction of sounds encompassing the audible frequency range from electrical signals representing said sounds.

Of particular significance in connection with the transfer function employed according to the present invention is the use of different poles in the best embodiments for the low-pass, band-pass and high-pass functions. For example, in the empirical method based on image-parameter theory just described, the individual low-pass, band pass, and high-pass functions will not in general share any common poles, because each of the aforementioned functions are calculated, and later empirically adjusted, independently of the others. It is characteristic to independently chosen brick-wall amplitude functions having mutually exclusive frequency passbands, that the denominator poles of their respective transfer functions be generally different, as illustrated earlier in FIG. 14 and the textual explanation of this same figure given hereinbefore. The functions that have been used according to the proposals of the prior art have mainly had the same poles in the denominator parts for low-pass, band pass and high-pass functions. The prior art workers, in attempting to achieve a closer approximation to the ideal transfer function, have concentrated on the numerator parts of the functions, as is evident from the three papers of the Journal of the Audio Engineering Society mentioned hereinbefore.

An example of a prior art crossover system having crossover filter transfer functions not possessing brick-wall amplitude vs. frequency characteristics but in which different poles appear in the denominator parts for low-pass and high-pass functions is contained in U.S. Pat. No. 2,612,558 issued to P. W. Klipsch on Aug. 13, 1946. However, crossover designs in which different poles appear in the denominator parts of the transfer functions of individual elements have fallen into disfavor in recent times.

What is claimed is:

1. A louspeaker apparatus comprising a woofer driver with a frequency response range of 20 Hz to 150 Hz, a lower midrange driver with a frequency response range of 150 Hz to 800 Hz, an upper midrange driver with a frequency response range of 800 Hz to 5000 Hz and a tweeter driver with a frquency response range of 5000 Hz to 20,000 Hz that are connected to a signal input terminal and a ground terminal, with a connection to said input terminal being made through a crossover filter network, which includes the following circuitry:

a 5.1 millihenry first inductor having one terminal thereof connected to said input terminal, a 5.1 millihenry second inductor connected between the other terminal of said first inductor and one terminal of said woofer driver which has its other terminal connected to said ground terminal, a 3.2 millihenry third inductor mutually coupled to said second inductor and having one terminal thereof connected at said connection of said second inductor to said woofer, a 100 microfarad first capacitor connected between the other terminal of said third inductor and said ground terminal, a 220 microfarad second capacitor connected between said connection of said first inductor to said second inductor and said ground terminal, a 100 microfarad third capacitor having one terminal thereof connected to said input terminal, a 1.55 millihenry fourth inductor having one terminal thereof connected to the other terminal of said third capacitor, a 1.7 millihenry fifth inductor connected between the other terminal of said fourth inductor and one terminal of said lower midrange driver which has its other terminal connected to said ground terminal, a 30 ohm first resistor conencted between said ground terminal and said connection of said fifth inductor to said lower midrange driver, a 757 microhenry sixth inductor mutually coupled to said fifth inductor and having one terminal thereof connected at said connection of said fifth inductor to said lower midrange driver, a 16 microfarad fourth capacitor connected between said ground terminal and the other terminal of said sixth inductor, a 36 microfarad fifth capacitor connected between said ground terminal and said connection of said fourth inductor to said fifth inductor, an 8.4 millihenry seventh inductor having one terminal thereof connected at said connection of said third capacitor to said fourth inductor, a 470 microfarad sixth capacitor connected between said ground terminal and the other terminal of said seventh inductor, a 16 microfarad seventh capacitor having one terminal thereof connected at said connection of said third capacitor to said fourth inductor, a 757 microhenry eighth inductor connected between said ground terminal and the other terminal of said seventh capacitor, a 14 microfarad eighth capacitor having one terminal thereof connected at said connection of said eighth inductor to said seventh capacitor, a 320 microhenry ninth inductor having one terminal theroef connected to the other terminal of said eighth capacitor, a 540 microhenry tenth inductor connected between the other terminal of said ninth inductor and one terminal of said upper midrange driver which has its other terminal connected to said ground terminal, a 30 ohm second resistor connected between said ground terminal and said connection of said tenth inductor to said upper midrange driver, a 215 microhenry eleventh inductor mutually coupled to said tenth inductor and having one terminal thereof connected at said connection of said tenth inductor to said upper midrange driver, a 3.3 microfarad ninth capacitor connected between said ground terminal and the other terminal of said eleventh inductor, a 10 microfarad tenth capacitor connected between said ground terminal and said connection of said ninth inductor to said tenth inductor, a 2.1 millihenry twelfth inductor having one terminal thereof connected at said connection of said eighth capacitor to said ninth inductor, a 24 microfarad elventh capacitor connected between said ground terminal and the other terminal of said twelfth inductor, a 3.0 microfarad twelfth capacitor having one terminal thereof connected to said connection of said eighth capacitor to said ninth inductor, a 170 microhenry thirteenth inductor connected between said ground terminal and the other terminal of said twelth capacitor, a 1.0 microfarad thirteenth capacitor having one terminal thereof connected at said connection of said twelth capacitor to said thirteenth inductor, a 1.68 microfarad fourteenth capacitor having one terminal thereof connected to both the other terminal of said thirteenth capacitor and one terminal of said tweeter driver, which has its other terminal connected to said ground terminal, a 540 microhenry fourteenth inductor mutually coupled with said thirteeth inductor and connected between said ground terminal and the other terminal of said fourteenth capacitor, a 15 ohm third resistor connected between said ground terminal and said connection of said fourteenth capacitor to said thirteenth capacitor, said circuit elements in said crossover filter network and said drivers operating in combination to provide separate and adjacently disposed audio output transfer functions for said drivers within the overall transfer function for audio output from said loudspeaker apparatus and also to provide transmission zeros in said transfer function for audio output from said loudspeaker apparatus at frequencies outside the flat ranges of frequencies over which substantially no attenuation occurs for said drivers to assure that said flat range of frequencies for each said driver is exclusive and distinct from said flat ranges of frequencies for said other drivers.

2. A loudspeaker system comprising in combination: at least first and second loudspeaker drivers:

first crossover filter network network means connected to said first loudspeaker driver and having first inductance means, first capacitance means, and first resistance means arranged to pass, in a first transfer function relationship, first signals of a first frequency range which first signals have a substantially flat signal amplitude response over said first frequency range and arranged to accept first unwanted signal portions whose frequencies are higher than the frequencies of said first frequency range;

said first crossover filter network means further including second inductance means and second capacitance means designed and arranged with respect to said first inductance means, to said first capacitance means, and to said first resistance means to add a zero of transmission characteristic, to said first transfer function relationship, at a frequency higher than the frequency of said first frequency range whereby said first unwanted signal portions are attenuated at a rate of 40 db per octave or greater;

second crossover filter network means connected to said second loudspeaker driver and having third inductance means, third capacitance means, and third resistance means arranged to pass, in a second transfer function relationship, second signals of a second frequency range having a frequencies higher than said first frequency range which second signals have a substantially flat signal amplitude response over said second frequency range and arranged to accept second unwanted signal portions whose frequencies are outside of said second frequency range and lower than frequencies of said second frequency range;

said second crossover filter network means further including fourth inductance means and fourth capacitance means designed and arranged with respect to said third inductance means, to said third capacitance means and to said third resistance means to add a zero of transmission characteristic to said second transfer function relationship at a frequency lower than the frequencies of said second frequency range so that said second unwanted signal portions are attenuated at a rate of 40 db per octave or greater, whereby when said first unwanted signal portions and said second unwanted signal portions have amplitudes of 10 db below said amplitude responses respectively of said first and second signals the frequency difference between said first and second unwanted signal portions is sufficiently small that said first and second unwanted signals portions are barely audible.

3. A loudspeaker system according to claim 2 wherein said frequency difference between said first and second unwanted signal portions is $\frac{1}{3}$ octave or less.

4. A loudspeaker system according to claim 2 wherein said first inductance means is mutually coupled to said second inductance means and wherein said third inductance means is mutually coupled to said fourth inductance means.

5. A loudspeaker system comprising in combination: at least first, second, third and fourth loudspeaker drivers; first crossover filter network means connected to said first loudspeaker driver and having first inductance means, first capacitance means, and first resistance means arranged to pass, in a first transfer function relationship, first signals of a first frequency range which first signals have a substantially flat signal amplitude response over said first frequency range and arranged to accept first unwanted signal protions whose frequencies are higher than the frequencies of said first frequency range;

said first crossover filter network means further including second inductane means and second capacitance means designed and arranged with respect to said first inductance means, to said first capacitance means, and to said first resistance means to add a zero of transmission characteristic, to said first transfer function relationship, at a frequency higher that the frequencies of said first frequency range whereby said first unwanted signal portions are attenuated at a rate of 40 db per octave or greater;

second crossover filter network means connected to said second loudspeaker driver and having third inductance means, third capacitance means, and third resistance means arranged to pass, in a second transfer functions relationship, second signals of a second frequency range having frequencies higher than said first frequency range and which second signals have a substantially flat signal amplitude response over said second frequency range and arranged to accept second and third unwanted signal portions whose frequencies are outside of said second frequency range and which second unwanted signals have frequencies which are loser than the frequencies of said second frequency range and which third unwanted signals have frequencies which are higher than the frequencies of said second frequency range;

said second crossover filter network means further including fourth inductance means and fourth capacitance means designed and arranged with respect to said third inductance means, to said third capacitance means and to said third resistance means to add a first and second zero of transmission characteristic to said second transfer function relationship respectively at a frequency lower than the frequencies of said second frequency range and at a frquency higher than the frequencies of said second frequency range so that both said second and third unwanted signal portions are attenuated at a rate of 40 db per octave or greater, whereby when said first unwanted signal portions adnd said second unwanted signal portions have amplitudes of 10 db below said amplitude response respectively of said first and second signals the frequency difference between said first and second unwanted signal portions is sufficiently small that said first sand second unwanted signal portions are barely audible;

third crossover filter network means connected to said third loudspeaker driver and having fifth inductance means, fifth capacitance means, and fifth resistance means arranged to pass, in a third transfer function relationship, third signals of a third frequency range having frequencies higher than said second frequency range and which third signals have a substasntially flat signal amplitude response over said third frequency range and arranged to accept fourth and fifth unwanted signal portions whose frequencies are outside of said third frequency range and which fourth unwanted signal portions have frequencies which are lower than the frequencies of said third frequency range and which fifth unwanted signals have frequencies which are higher than the frequencies of said third frequency range;

said third crossover filter network means further including sixth inductance means and sixth capacitance means designed and arranged with respect to said fifth inductance means, to said fifth capacitance means and to said fifth resistance means to add a first and second zero of transmission characteristic to said third transfer function relationship respectively at a frequency lower than the frequencies of said third frequency range and at a frequency higher than the frequencies of said third frequency range so that both said fourth and fifth unwanted signal portions are attenuated at a rate of 40 db per octave or greater, whereby when said third unwanted signal portions and said fourth unwanted signal portions have amplitudes of 10 db below said amplitude responses respectively of said second and third signals the frequency difference between said third and fourth unwanted signal portions is sufficiently small that said third and fourth unwanted signal portions are barely audible;

fourth crossover filter network means connected to said fourth louspeaker driver and having seventh inductance means, seventh capacitance means, and seventh resistance means arranged to pass, in a fourth transfer function relationship, fourth signals of a fourth frequency range having frequencies higher than said third frequency range and which fourth signals have a substantially flat signal amplitude response over said fourth frequency range and arranged to accept sixth unwanted signal portions whose frequencies are outside of said fourth frequency range and which sixth unwanted signal portions have frequecies which are lower than the frequencies of said fourth frequency range;

said fourth crossover filter network means further including eighth inductance means and eighth capacitance means designed and arranged with respect to said seventh inductance means, to said seventh capacitance means and to said seventh resistance means to add a zero of transmission characteristic to said fourth transfer function relationship at a frequency lower than the frequecies of said fourth frequency range so that said sixth unwanted signal portions are attenuated at a rate of 40 db per octave or greater, whereby when said fifth unwanted signal portions and said sixth unwanted signal portions have amplitudes of 10 db below said amplitude responses respectively of said third and fourth signals the frequency difference between said fifth and sixth unwanted signal portions is sufficiently small that said fifth and sixth unwanted signal portions are barely audible.

6. A loudspeaker system according to claim 5 wherein the difference in frequency between said first unwanted signal portions and said second unwanted signal portions and between said third unwanted signal portions and said fourth unwanted signal portions and between said fifth unwanted signal portions and said sixth unwanted signal portions is each $\frac{1}{3}$ octave or less.

* * * * *

UNITED STATES PATENT AND TRADEMARK OFFICE

CERTIFICATE OF CORRECTION

PATENT NO. : 4,771,466

DATED : September 13, 1988

INVENTOR(S) : RICHARD MODAFFERI

It is certified that error appears in the above-identified patent and that said Letters Patent is hereby corrected as shown below:

In the drawings, Sheet 6, Figure 10, a capacitor C10 is inserted between inductor L14 and a ground, as shown below:

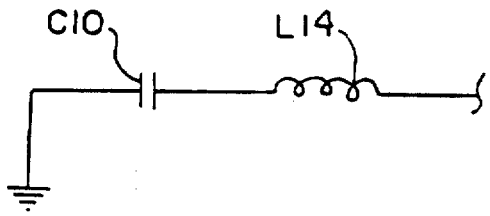

UNITED STATES PATENT AND TRADEMARK OFFICE

CERTIFICATE OF CORRECTION

PATENT NO. : 4,771,466

DATED : September 13, 1988

INVENTOR(S) : Richard Modafferi

It is certified that error appears in the above-identified patent and that said Letters Patent is hereby corrected as shown below:

| | |
|---|---|
| Column 1, line 63 | insert --;-- between "jw" and "K" |
| Column 2, line 51 | change the equation number from "(4)" to --(5)-- |
| Column 7, line 4 | change "topology,employed" to --topology employed-- |
| Column 7, line 13 | change "and, a" to --and a-- |
| Column 9, line 29 | change "series" to --series.-- |
| Column 10, line 25 | change "inidividual" to --individual-- |
| Column 27, line 66 | change "frquency" to --frequency-- |
| Column 28, line 28 | change "conencted" to --connected-- |
| Column 28, line 57 | change "theroef" to --thereof-- |
| Column 29, line 12 | change "elventh" to --eleventh-- |
| Column 29, line 20 | change "twelth" to --twelfth-- |
| Column 29, line 23 | change "twelth" to --twelfth-- |
| Column 29, line 30 | change "thirteeth" to --thirteenth-- |
| Column 30, line 11 | delete "a" after "having" |
| Column 30, line 61 | change "inductane" to --inductance-- |
| Column 31, line 15 | change "loser" to --lower-- |
| Column 31, line 29 | change "frquency" to --frequency-- |
| Column 31, line 33 | change "adnd" to --and-- |
| Column 31, line 38 | change "sand" to --and-- |
| Column 31, line 48 | change "substasntially" to --substantially-- |
| Column 32, line 31 | change "frequecies" to --frequencies-- |
| Column 32, line 40 | change "freqecies" to --frequencies-- |

UNITED STATES PATENT AND TRADEMARK OFFICE

CERTIFICATE OF CORRECTION

PATENT NO. : 4,771,466

DATED : September 13, 1988

INVENTOR(S) : Richard Modafferi

It is certified that error appears in the above-identified patent and that said Letters Patent is hereby corrected as shown below:

Column 19, lines 40-41, the equation should appear as follows:

$$\frac{eo}{e} = \frac{C_1 s^2 (As^2 + B)}{\gamma s^6 + Bs^5 + \alpha s^4 + as^3 + \delta s^2 + \tau s + K}$$

Signed and Sealed this

Fifteenth Day of August, 1989

*Attest:*

*Attesting Officer*

DONALD J. QUIGG

*Commissioner of Patents and Trademarks*